US007432883B2

(12) United States Patent
Oyama et al.

(10) Patent No.: US 7,432,883 B2
(45) Date of Patent: Oct. 7, 2008

(54) DRIVING METHOD FOR ELECTRON-EMITTING DEVICE, DRIVING METHOD FOR ELECTRON SOURCE, MANUFACTURING METHOD FOR ELECTRON SOURCE, AND IMAGE DISPLAY APPARATUS

(75) Inventors: Kazunari Oyama, Kanagawa (JP); Masafumi Kyogaku, Kanagawa (JP); Takeo Tsukamoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 100 days.

(21) Appl. No.: 10/764,538

(22) Filed: Jan. 27, 2004

(65) Prior Publication Data

US 2004/0183757 A1 Sep. 23, 2004

(30) Foreign Application Priority Data

Jan. 28, 2003 (JP) ..... 2003-019171
Jan. 19, 2004 (JP) ..... 2004-010974

(51) Int. Cl.
*G09G 3/20* (2006.01)

(52) U.S. Cl. ..... 345/75.2; 445/3

(58) Field of Classification Search ..... 345/47, 345/49, 52, 36, 75.2, 210; 315/169.3; 250/423 F, 250/492.24; 445/3, 6
See application file for complete search history.

(56) References Cited

U.S. PATENT DOCUMENTS 4,904,895 A 2/1990 Tsukamoto et al. ..... 313/336
5,430,300 A * 7/1995 Yue et al. ..... 250/423 F
5,588,893 A 12/1996 Kaftanov et al. ..... 445/6
5,773,921 A 6/1998 Keesmann et al. ..... 313/309
5,847,495 A 12/1998 Yamanobe et al. ..... 313/310
5,872,422 A 2/1999 Xu et al. ..... 313/311
5,973,444 A 10/1999 Xu et al. ..... 313/309
5,973,446 A 10/1999 Kaftanov et al. ..... 313/309
5,986,389 A 11/1999 Tsukamoto ..... 313/310
6,066,922 A * 5/2000 Iwasaki et al. ..... 315/169.3
6,147,449 A 11/2000 Iwasaki et al. ..... 313/495
6,171,162 B1 1/2001 Iwasaki et al. ..... 445/6

(Continued)

FOREIGN PATENT DOCUMENTS

EP 0 785 564 A1 7/1997

(Continued)

OTHER PUBLICATIONS

C.A. Spindt et al., *Physical Properties of Thin-Film Field Emission Cathodes with Molybdenum Cones*, Journal of Applied Physics, vol. 47, No. 12, pp. 5248-5263 (1976).

(Continued)

*Primary Examiner*—Kent Chang
(74) *Attorney, Agent, or Firm*—Fitzpatrick, Cella, Harper & Scinto

(57) ABSTRACT

In a driving method for an electron-emitting device in which an electron-emitting member made of an aggregate of carbon fibers is made to emit electrons by a voltage being applied between a cathode electrode on which the electron-emitting member is formed and a counter electrode disposed in opposition to the cathode electrode, a driving voltage V smaller than a maximum applied voltage Vmax is applied between the cathode electrode and the counter electrode to drive the electron-emitting device, the maximum applied voltage Vmax being a maximum voltage applied between the cathode electrode and the counter electrode before the start of driving.

21 Claims, 26 Drawing Sheets

U.S. PATENT DOCUMENTS

| | | | | |
|---|---|---|---|---|
| 6,179,678 | B1 | 1/2001 | Kishi et al. | 445/24 |
| 6,184,610 | B1 | 2/2001 | Shibata et al. | 313/309 |
| 6,184,851 | B1 * | 2/2001 | Yamaguchi et al. | 345/75.2 |
| 6,225,749 | B1 | 5/2001 | Kobayashi et al. | 315/169.3 |
| 6,231,412 | B1 | 5/2001 | Kawade et al. | 445/3 |
| 6,231,413 | B1 | 5/2001 | Tsukamoto | 445/24 |
| 6,246,168 | B1 | 6/2001 | Kishi et al. | 313/495 |
| 6,288,494 | B1 | 9/2001 | Tsukamoto et al. | 315/169.1 |
| 6,380,914 | B1 | 4/2002 | Xie | 345/75.2 |
| 6,388,384 | B1 | 5/2002 | Pierrejean | 315/111.81 |
| 6,409,563 | B1 | 6/2002 | Tamura et al. | 445/3 |
| 6,455,021 | B1 | 9/2002 | Saito | 423/447.3 |
| 6,472,814 | B1 | 10/2002 | Yamanobe et al. | 313/495 |
| 6,490,433 | B1 | 12/2002 | Kawade | 455/6 |
| 6,515,640 | B2 | 2/2003 | Tsukamoto et al. | 345/75.2 |
| 6,626,719 | B2 | 9/2003 | Ono et al. | 445/24 |
| 6,628,053 | B1 | 9/2003 | Den et al. | 313/310 |
| 6,645,028 | B1 * | 11/2003 | Dean et al. | 445/6 |
| 6,712,660 | B2 * | 3/2004 | Aoki et al. | 445/3 |
| 6,794,666 | B2 * | 9/2004 | Choi et al. | 250/492.24 |
| 2002/0009637 | A1 | 1/2002 | Murakami et al. | 429/213 |
| 2002/0031972 | A1 * | 3/2002 | Kitamura et al. | 445/3 |
| 2002/0047513 | A1 | 4/2002 | Nomura | 313/495 |
| 2002/0057045 | A1 | 5/2002 | Tsukamoto | 313/309 |
| 2002/0060516 | A1 | 5/2002 | Kawate et al. | 313/495 |
| 2002/0074947 | A1 | 6/2002 | Tsukamoto | 315/169.3 |
| 2002/0132041 | A1 | 9/2002 | Yamanobe et al. | 427/77 |
| 2002/0175618 | A1 * | 11/2002 | Lee et al. | 313/495 |
| 2003/0006684 | A1 | 1/2003 | Kawate et al. | 313/311 |
| 2003/0048055 | A1 | 3/2003 | Ishikura et al. | 313/311 |
| 2003/0048056 | A1 | 3/2003 | Kitamura et al. | 313/311 |
| 2003/0048057 | A1 | 3/2003 | Oyama et al. | 313/311 |
| 2003/0057860 | A1 | 3/2003 | Tsukamoto | 315/169.3 |
| 2003/0124944 | A1 | 7/2003 | Kyogaku et al. | 445/6 |
| 2003/0162464 | A1 | 8/2003 | Kyogaku et al. | 445/24 |
| 2004/0060477 | A1 | 4/2004 | Iwaki et al. | 106/472 |
| 2004/0063839 | A1 | 4/2004 | Kawate et al. | 524/439 |
| 2004/0155567 | A1 | 8/2004 | Kyogaku et al. | 313/310 |
| 2004/0183422 | A1 | 9/2004 | Kuroda et al. | 313/310 |

FOREIGN PATENT DOCUMENTS

| | | | |
|---|---|---|---|
| EP | 0 913 508 | A2 | 5/1999 |
| EP | 0 809 854 | | 11/2000 |
| EP | 1 122 344 | A2 | 8/2001 |
| EP | 1 187 161 | A2 | 3/2002 |
| EP | 1 245 704 | A2 | 10/2002 |
| EP | 1 291 889 | A2 | 3/2003 |
| EP | 1 291 891 | A2 | 3/2003 |
| JP | 08-096700 | | 4/1996 |
| JP | 09-259753 | | 10/1997 |
| JP | 2000-95509 | | 4/2000 |
| JP | 2000-155555 | | 6/2000 |
| JP | 2002-150929 | | 5/2002 |
| JP | 2003-536215 | | 12/2003 |
| WO | WO 01/95360 | | 12/2001 |

OTHER PUBLICATIONS

S. Iijima, *Helical Microtubules of Graphitic Carbon*, Nature, vol. 354, pp. 56-58 (1991).

Nikkei Mechanical, No. 567, pp. 36-57 (2001).

V. Semet et al., *Field Electron Emission from Individual Carbon Nanotubes of a Vertically Aligned Array*, Applied Physics Letters, vol. 81, No. 2, pp. 343-345 (2002).

P. Collins et al., *Unique Characteristics of Cold Cathode Carbon-Nanotube-Matrix Field Emitters*, Physical Review B, vol. 55, No. 15, pp. 9391-9399 (1997).

X. Xu et al., *A Method for Fabricating Large-Area, Patterned, Carbon Nanotube Field Emitters* Applied Physics Letters, vol. 74, No. 17, pp. 2549-2551 (1999).

Y. C. Choi et al., *Controlling the Diameter, Growth Rate, and Density of Vertically Aligned Carbon Nanotubes Synthesized by Microwave Plasma-Enhanced Chemical Vapor Deposition*, Applied Physics Letters, vol. 76, No. 17, pp. 2367-2369 (2000).

* cited by examiner

DRIVING METHOD FOR ELECTRON-EMITTING DEVICE, DRIVING METHOD FOR ELECTRON SOURCE, MANUFACTURING METHOD FOR ELECTRON SOURCE, AND IMAGE DISPLAY APPARATUS

BACKGROUND OF THE INVENTION

1. Field of the Invention

The present invention relates to driving methods for electron-emitting devices using carbon fibers, driving methods for electron sources, manufacturing methods for electron sources, and image display apparatus.

2. Description of the Related Art

Field emission types (hereinafter referred to as "FE type (s)") of electron-emitting devices have heretofore been known.

Examples of the FE types of electron-emitting devices are described in J. Appl. Phys. Vol. 47, No. 12, p. 5248 (1976) and others.

Fibrous carbon materials (carbon fibers) having nano-sized diameters, such as carbon nanotubes, have recently attracted attention as electron-emitting materials for the FE types.

Carbon nanotubes themselves are described in, for example, Nature, 354, (1991) 56. Aggregates of carbon fibers are described in, for example, JP-A-2000-095509 and Appl. Phys. Lett., Vol. 76, No. 17, pp. 2367–2369 (2000).

The techniques of using carbon nanotubes as electron-emitting materials for the FE types of electron-emitting devices are described in, for example, NIKKEI MECHANICAL, 2001. 12, No. 567, Appl. Phys. Lett., Vol. 81, No. 2, pp. 343–345 (2002), U.S. Pat. No. 5,773,921, U.S. Pat. No. 6,645,028, U.S. Pat. No. 5,872,422 and U.S. Pat. No. 5,973,444.

In addition, for example, image display apparatuses, image forming apparatuses, image recording apparatuses, electron and ion beam sources have been researched as applications of an FE-type electron-emitting device which uses an aggregate (bundle) of a plurality of carbon fibers as its electron-emitting member.

As one of applications of such electron-emitting devices to image display apparatuses in particular, research has been conducted into an image display apparatus which uses in combination electron-emitting devices and phosphors serving to emit light by irradiation with electron beams.

By way of example, FIG. 23 shows a multi-electron source in which a multiplicity of FE-type electron-emitting devices are two-dimensionally arranged and these devices are wired in matrix form.

In FIG. 23, reference numeral 4001 denotes electron-emitting devices, reference numeral 4002 denotes row wirings, and reference numeral 4003 denotes column wirings. Actually, the row wirings 4002 and the column wirings 4003 have finite electrical resistance. However, in FIG. 23, the electrical resistance of the row wirings 4002 is shown as electrical resistance 4004, while the electrical resistance of the column wirings 4003 is shown as electrical resistance 4005. This wiring method is called "matrix wiring". For the convenience of illustration, a matrix of 6×6 is shown in FIG. 23, but the scale of the matrix is, of course, not limitative. For example, in the case of a multi-electron source for an image display apparatus, tens of thousands to tens of millions of devices which are sufficient to provide the desired image display are arranged and wired.

SUMMARY OF THE INVENTION

In the case where an aggregate of a plurality of carbon fibers (a carbon fiber bundle) is employed as the electron-emitting material of one FE-type electron-emitting device and this electron-emitting device is driven, the temporal stability of its electron emission characteristic is affected by the non-uniformity of the shapes of the respective carbon fibers.

In general, since electric fields easily concentrate at carbon fibers of small diameter, large electron emission can be obtained from such carbon fibers, whereas the carbon fibers greatly degrade with the lapse of time. In the case where an aggregate of carbon fibers is used as an electron-emitting material, at a constant voltage driving, thinner fibers degrade faster with time, so that the amount of emission current of the entire aggregate becomes gradually smaller. For this reason, the electron emission characteristic of an aggregate of carbon fibers (a carbon fiber bundle) having non-uniform diameters become unstable. In addition, the non-uniformity of the shapes of carbon fibers will cause not only temporal instability of driving but also the non-uniformity of electron emission in a plane where carbon fibers are formed.

The non-uniformity of the shapes of carbon fibers in the aggregate of carbon fibers denotes not only the non-uniformity of the diameters of carbon fibers in the aggregate but also the non-uniformity of all shapes and forms associated with electron emission, such as the length of carbon fibers and the size of each stacked graphite sheet on which one graphite nanofiber is formed.

However, even if narrowed diameter distribution in aggregates of carbon fibers is realized, it is difficult to satisfactorily control the non-uniformity of the lengths of carbon fibers, and further, the non-uniformity of the size of each graphite sheet which constitutes a carbon fiber.

In the case where electron-emitting devices each having the above-described aggregate of carbon fibers are used in an image display apparatus, each of the electron-emitting devices is required to maintain uniform and suitable brightness and contrast for a long time.

To realize this feature, each of the electron-emitting devices is required to emit at least a constant number of electrons for an expected length of time by restraining a temporal decrease in the number of electrons to be emitted from each of the electron-emitting devices.

Therefore, it is necessary to eliminate the non-uniformity of all shapes of carbon fibers in an aggregate of carbon fibers, which is a cause of the non-uniformity of electron emission. However, at present, it is difficult to eliminate the non-uniformity of all shapes in the process of manufacturing aggregates of carbon fibers.

Accordingly, there is a demand for an art capable of uniformizing the electron emission characteristics of an aggregate of carbon fibers by simple techniques.

In addition, in an electron source in which a multiplicity of electron-emitting devices each using an aggregate of carbon fibers as its electron-emitting member are arranged, a small degree of non-uniformity occurs in the electron emission characteristics of individual electron-emitting devices owing to factors such as variations in the manufacturing process. As a result, when an image display apparatus is fabricated using such an electron source, the non-uniformity of its characteristics occasionally appears as the non-uniformity of luminance.

As the reason why electron emission characteristics differ among individual electron-emitting devices in this manner, it is considered that there are various causes such as the non-uniformity of the components of a material used in electron-emitting devices and the errors of the dimensions and shapes of members of each device. However, if all these causes are to be eliminated, highly advanced manufacturing equipment and extremely strict schedule control are necessary, but huge manufacturing cost is needed to satisfy this necessity.

The invention has been made in view of the above-described problems of the related art, and an object of the invention is to provide a driving method for an electron-emitting device which is capable of stably driving an electron-emitting device using an aggregate of carbon fibers as an electron-emitting member, for a long time.

Another object of the invention is to provide a manufacturing method and a driving method both of which is capable of restraining the non-uniformity of electron emission characteristics among individual electron-emitting devices in an electron source (or in an image-forming apparatus) in which a plurality of electron-emitting devices each using an aggregate of carbon fibers as an electron-emitting member are arranged.

To achieve the above objects, the invention provides a driving method for an electron-emitting device in which an electron-emitting member including a plurality of carbon fibers is made to emit electrons by a voltage being applied between a cathode electrode on which the electron-emitting member is formed and a counter electrode disposed in opposition to the cathode electrode. The driving method includes the step of applying a driving voltage V smaller than a maximum applied voltage Vmax between the cathode electrode and the counter electrode to drive the electron-emitting device, the maximum applied voltage Vmax being a maximum voltage applied between the cathode electrode and the counter electrode before the start of driving.

The invention also provides a driving method for an electron source including a plurality of electron-emitting devices formed on a substrate, in each of which an electron-emitting member including a plurality of carbon fibers is capable of emitting electrons when a driving voltage is applied between a cathode electrode on which the electron-emitting member is formed and a counter electrode disposed in opposition to the cathode electrode. The driving method includes the steps of: applying a voltage Vmax higher than the driving voltage to a first electron-emitting device to cause an I-V characteristic of the first electron-emitting device and an I-V characteristic of a second electron-emitting device to become closer to each other, the first electron-emitting device being operative to emit a relatively larger number of electrons among the plurality of electron-emitting devices when a predetermined voltage is applied, the second electron-emitting device being operative to emit a relatively smaller number of electrons among the plurality of electron-emitting devices when the predetermined voltage is applied; and applying, according to input data, a driving voltage V smaller than the maximum applied voltage Vmax between the cathode electrode and the counter electrode to drive the plurality of electron-emitting devices.

According to either of the above-described driving methods, it is possible to realize stable driving of the electron-emitting devices through the respective aggregates of carbon fibers each serving as the electron-emitting member.

Letting I be an emission current obtained when the driving voltage V is applied, it is preferable to select the driving voltage V from a low-voltage region in which the relationship between 1/V and $\log(I/V^2)$ becomes approximately linear.

According to either of the above-described driving methods, it is possible to effect stable driving of the electron-emitting devices with high reproducibility in an approximately linear, simple relationship.

The invention also provides a manufacturing method for an electron source including a plurality of electron-emitting devices formed on a substrate, in each of which an electron-emitting member including a plurality of carbon fibers is capable of emitting electrons when a driving voltage is applied between a cathode electrode on which the electron-emitting member is formed and a counter electrode disposed in opposition to the cathode electrode. The manufacturing method includes the step of applying a voltage higher than the driving voltage to a first electron-emitting device to cause an I-V characteristic of the first electron-emitting device and an I-V characteristic of a second electron-emitting device to become closer to each other, the first electron-emitting device being operative to emit a relatively larger number of electrons among the plurality of electron-emitting devices when a predetermined voltage is applied, the second electron-emitting device being operative to emit a relatively smaller number of electrons among the plurality of electron-emitting devices when the predetermined voltage is applied.

According to the above-described manufacturing method, it is possible to realize electron emission characteristics of high uniformity in the electron source including the plurality of electron-emitting devices.

It is preferable that the I-V characteristic includes an inclination and an intercept of the relationship between 1/V and $\log(I/V^2)$ in a low-voltage region in which the relationship between 1/V and $\log(I/V^2)$ is approximately linear.

The invention provides another manufacturing method for an electron source including a plurality of electron-emitting devices formed on a substrate in a matrix form, in each of which an electron-emitting member including a plurality of carbon fibers is made to emit electrons when a driving voltage is applied between a cathode electrode on which the electron-emitting member is formed and a counter electrode disposed in opposition to the cathode electrode. The manufacturing method includes: a measuring step of applying a characteristic measuring voltage for measuring electron emission characteristic of the respective plurality of electron-emitting devices; a reference value selecting step of finding a reference value for the electron emission characteristics of the respective plurality of electron-emitting devices on the basis of the measured electron emission characteristics; and a characteristic shift voltage applying step of applying characteristic shift voltages to the respective plurality of electron-emitting devices to cause the electron emission characteristics of the respective plurality of electron-emitting devices to become closer to a value corresponding to the reference value.

According to the above-described manufacturing method, it is possible to realize electron emission characteristics of high uniformity in the electron source.

Preferably, the manufacturing method furthers includes, after the characteristic shift voltage applying step, a step of again measuring the electron emission characteristics of the respective plurality of electron-emitting devices and a step of again applying the characteristic shift voltage to a relevant electron-emitting device on the basis of a result measured again.

According to the above-described manufacturing method, it is possible to realize electron emission characteristics of high uniformity in the electron source.

Preferably, in the measuring step, when any one of the electron-emitting devices is driven each time, an emission current emitted from the driven electron-emitting device is measured.

According to this method, it is possible to easily know the electron emission characteristic of each of the electron-emitting devices in the electron source.

Preferably, in the measuring step, when any one of the electron-emitting devices is driven each time, a current flowing in the driven electron-emitting device is measured.

According to this method, it is possible to easily know the electron emission characteristic of each of the electron-emitting devices in the electron source.

Preferably, in the measuring step, when any one of the electron-emitting devices is driven each time, measurement is performed on the emission luminance of a phosphor which is caused to emit light by electrons emitted from the driven electron-emitting device, and the measured luminance is converted to a value corresponding to the emission current or a device current.

According to this method, it is possible to easily know the electron emission characteristic of each of the electron-emitting devices in the electron source.

Preferably, the aggregate of carbon fibers used in the invention is one kind selected from among an aggregate of graphite nanofibers, an aggregate of carbon nanotubes, and a mixed aggregate of graphite nanofibers and carbon nanotubes.

According to this method, it is possible to easily realize uniform device characteristics in a multi-electron source.

DETAILED DESCRIPTION OF THE PREFERRED EMBODIMENTS

Preferred embodiments of the invention will be illustratively described below in detail with reference to the accompanying drawings. In the following description, unless otherwise specified, the scope of the invention is not to be construed to be limited to specific factors such as dimensions, materials, shapes or relative arrangements of individual constituent components of preferred embodiments which will be described below.

Figure 1:
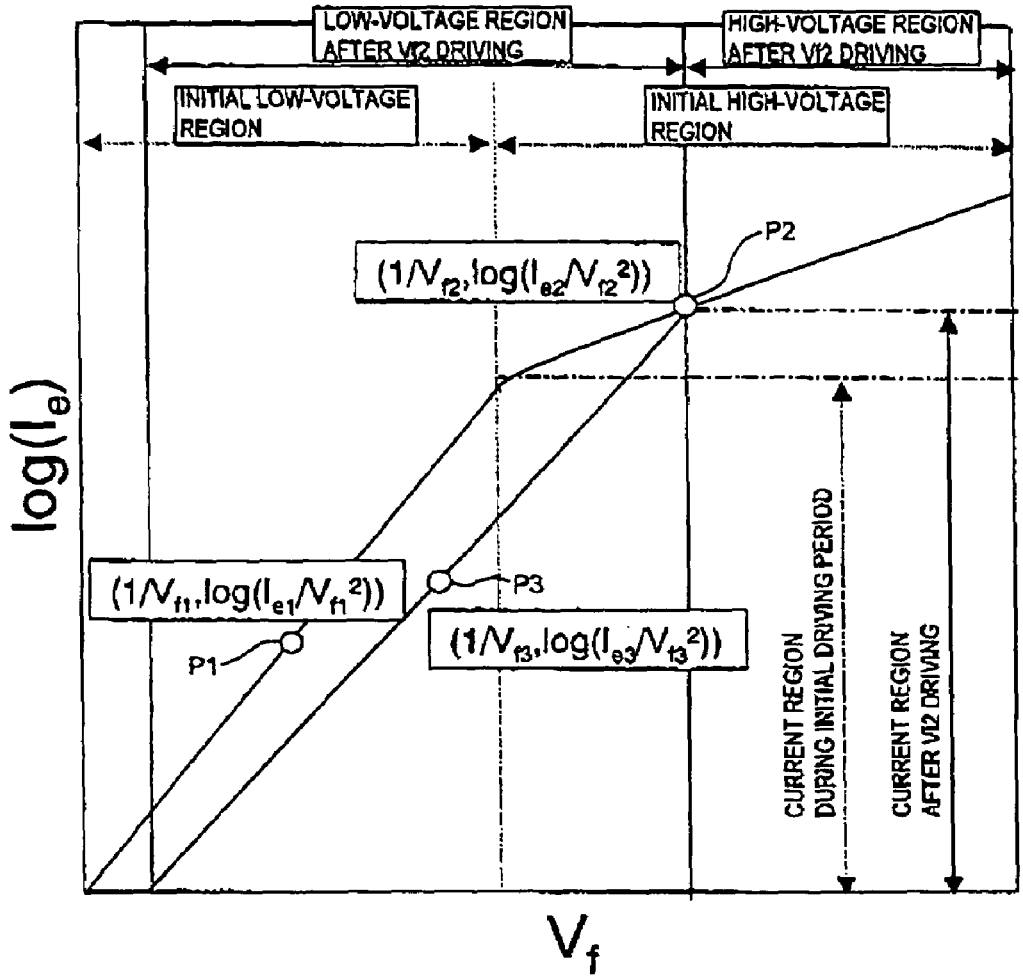
FIG. 1 is a graph showing a Vf-log(Ie) characteristic, aiding in describing the irreversible characteristic of an electron-emitting device according to Embodiment 1 of the invention.

FIG. 1 is a view aiding in describing a driving method for an electron-emitting device according to the invention. FIG. 1 is a semi-logarithmic graph showing the relationship (I-V characteristic) between a voltage Vf and the quantity of electrons (emission current) "Ie" which is emitted from an aggregate of carbon fibers when the voltage Vf is applied between a cathode electrode on which the aggregate of carbon fibers is disposed and a counter electrode disposed in opposition to the cathode electrode. The term "counter electrode" used herein indicates an electrode to which a potential for causing the aggregate of carbon fibers to emit electrons is applied.

In addition, "aggregate of a carbon fibers" in the present invention is only a plurality of carbon fibers, and member including a plurality of carbon fibers and other member (for example, member including a plurality of carbon fibers and catalyst particles, and a plurality of carbon fibers and glue). Therefore, with "an electron-emitting member made of an aggregate of carbon fibers" in the present invention, for example, it can be said in other words with "an electron-emitting member including a plurality of carbon fibers".

In one embodiment of the invention, before the start of driving of the electron-emitting device (typically, during the manufacture thereof), the maximum voltage applied between the cathode electrode and the counter electrode of the electron-emitting device is set to a maximum applied voltage Vmax, and when the electron-emitting device is to be driven (typically, after the manufacture thereof), a driving voltage V lower than the maximum applied voltage Vmax is applied between the cathode electrode and the counter electrode. This construction makes it possible to restraining the electron-emitting device from varying in its electron emission characteristic with time.

The invention has been made on the basis of findings obtained from experiments which will be described later, and first of all, the experiments will be described below to facilitate an understanding of the invention.

(Experiment 1)

Figure 2:
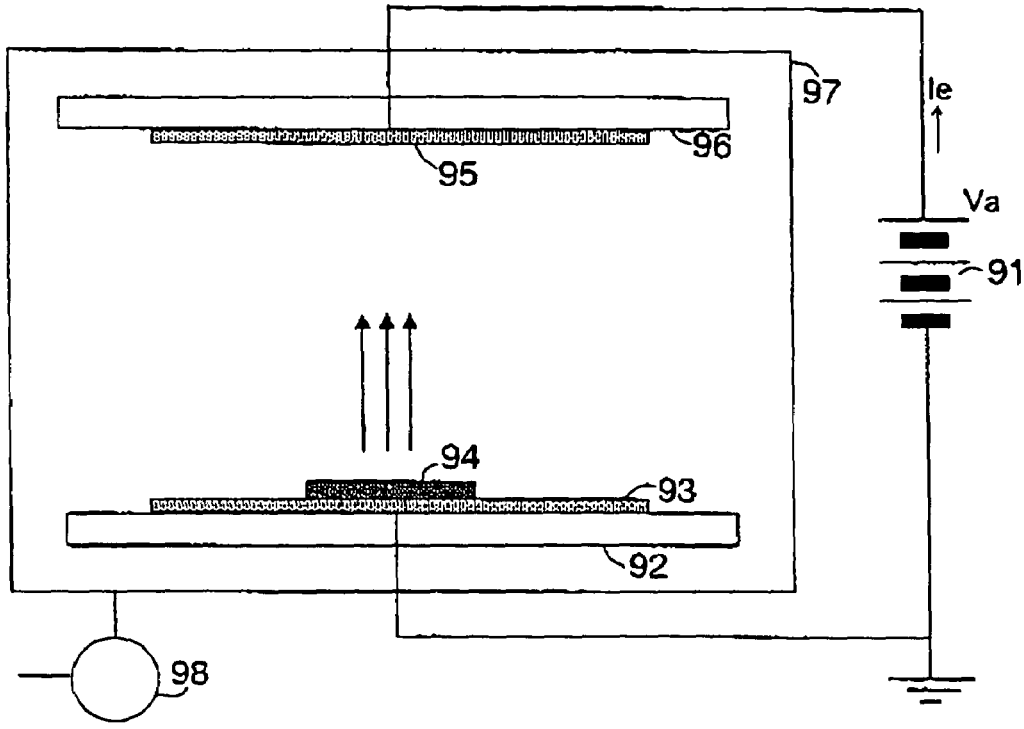
FIG. 2 is a schematic view showing one example of the electron-emitting device according to Embodiment 1 of the invention.

FIG. 2 is a schematic view showing one example of the electron-emitting device used in the invention.

As shown in FIG. 2, a cathode substrate 92 is disposed in the inside of a vacuum vessel 97. A cathode electrode 93 on which an aggregate 94 of carbon fibers constituting the electron-emitting device is placed is provided on a surface of the cathode substrate 92. An anode substrate 96 is disposed at a location opposite to the cathode electrode 93, and an anode electrode 95 which receives electrons emitted from the aggregate 94 of carbon fibers is provided on a surface of the anode substrate 96 as a counter electrode. A predetermined voltage is capable of being applied between the cathode electrode 93 and the anode electrode 95 by a voltage source 91. In addition, the vacuum vessel 97 is provided with an evacuation system 98 for evacuating the inside of the vacuum vessel 97.

Each of the cathode substrate 92 and the anode substrate 96 shown in FIG. 2 may use, for example, a glass substrate (PD200, manufactured by Asahi Glass Co. Ltd.) The cathode electrode 93 may be fabricated from TiN thin film, while the anode electrode 95 may be fabricated from ITO thin film.

Figure 3A:
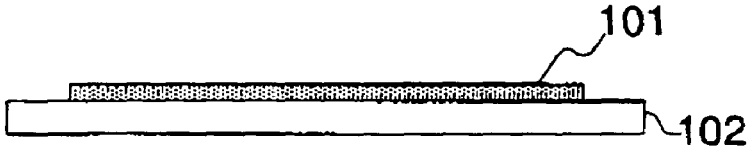
FIGS. 3A to 3C are cross-sectional schematic views showing a method of fabricating a cathode electrode and an electron-emitting device on the cathode electrode.
Figure 3B:
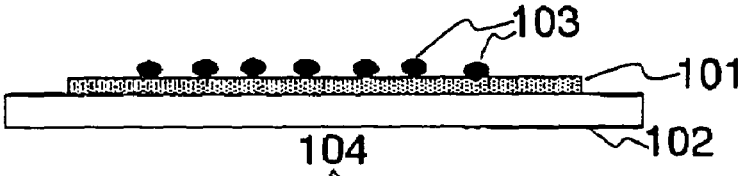
Figure 3C:
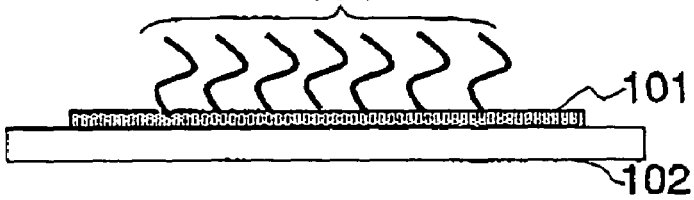

The aggregate 94 of carbon fibers may be formed as shown in FIGS. 3A to 3C by way of example. In FIGS. 3A to 3C, reference numeral 101 denotes a cathode electrode, reference numeral 102 denotes a cathode substrate, reference numeral 103 denotes catalyst particles, and reference numeral 104 denotes an aggregate of carbon fibers. One example of a manufacturing method for the aggregate 104 of carbon fibers will be described below in detail.

First of all, the TiN thin film 101 of thickness 100 nm is fabricated on a surface of the cathode substrate 102 by ion beam sputtering (FIG. 3A). Then, the catalyst particles 103 which promote the growth of carbon fibers are fabricated on the TiN thin film 101 by RF sputtering (FIG. 3B). The catalyst particles 103 may use palladium, cobalt, iron and nickel, or an alloy of two or more of these metals. The cathode substrate 102 on which the catalyst particles 103 are disposed is placed into a furnace, and the catalyst particles 103 are reduced by heating in a hydrogen gas atmosphere. After that, the cathode substrate 102 is heated in a hydrogen gas atmosphere into which a hydrocarbon gas has been introduced, thereby forming the aggregate 104 of carbon fibers on the cathode substrate 102 (FIG. 3C). The hydrocarbon gas may use, for example, methane, ethylene, acetylene, carbon monoxide, or carbon dioxide. Substrate heating temperatures at which the aggregate 104 of carbon fibers can be formed are between 450° C. and 800° C., and in this example, the cathode substrate 102 is heated at a temperature not higher than its strain point (570° C.).

From the SEM observation of the aggregate 104 of carbon fibers fabricated on the cathode electrode 101 in this manner, it can be seen that each carbon fiber has a thickness (diameter) of 5 nm to 60 nm and the aggregate 104 of carbon fibers has a film thickness of 0.3 μm to 15 μm. According to a Raman analysis, vibrations characteristic of graphite are observed near 1,580 $cm^{-1}$ and 1,340 $cm^{-1}$. In addition, according to a TEM observation, it can be confirmed that the aggregate 104 has a structure in which graphenes are stacked in the length direction of carbon fibers which are called graphite nanofibers.

The aggregate 94 of carbon fibers fabricated in this manner is disposed on the cathode electrode 93 as shown in FIG. 2, and a spacer (not shown) for maintaining the space between the cathode electrode 93 and the anode electrode 95 is disposed therebetween. Then, the inside of the vacuum vessel 97 is evacuated by the use of a turbo molecular pump, a dry pump and an ion pump. Incidentally, in FIG. 2, reference numeral 92 denotes the cathode substrate and reference numeral 96 denotes the anode substrate.

Figure 4:
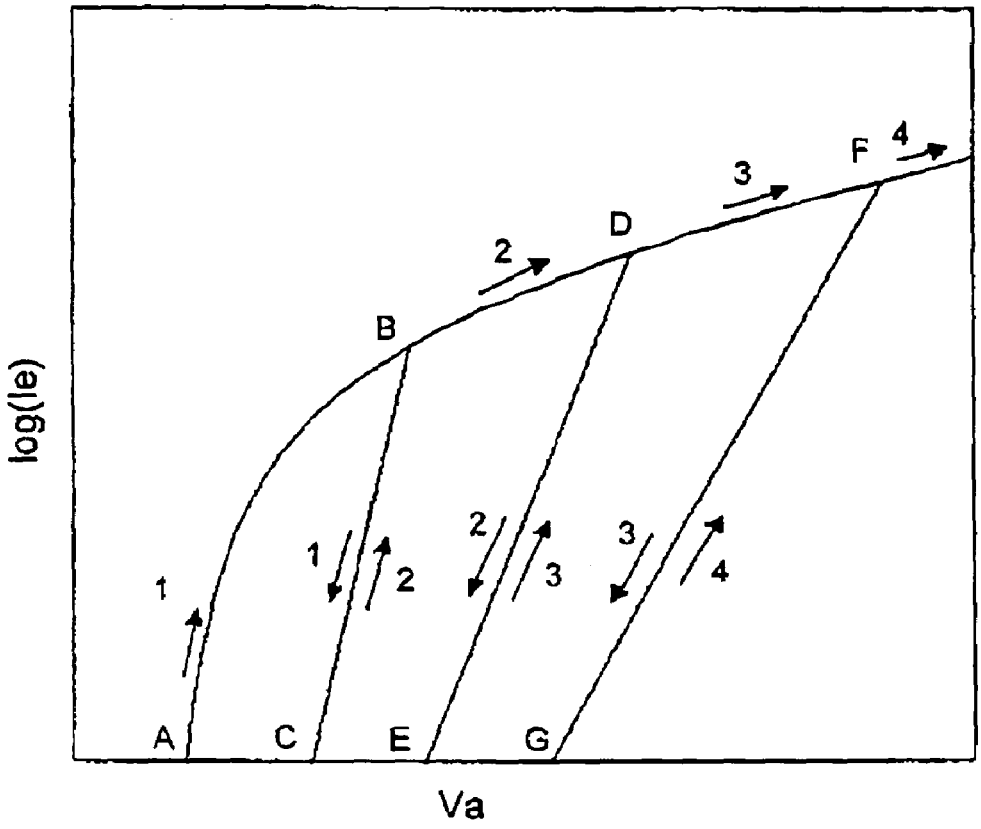
FIG. 4 is a graph showing the I-V characteristic of the electron-emitting device.

Then, increases and decreases in the voltage applied between the cathode electrode 93 and the anode electrode 95 are repeated. During this time, the process of increasing the voltage and then decreasing the voltage is performed as one cycle, and electron emission is performed during the increase of the voltage in each cycle by increasing a maximum voltage value to be applied between the cathode electrode 93 and the anode electrode 95. The I-V characteristic obtained during this time is shown in FIG. 4. In FIG. 4, the horizontal axis indicates the applied voltage, and the vertical axis indicates a logarithmic representation of emission current.

In FIG. 4, each group of curves (assigned any of numbers 1 to 4) indicates the number of times of voltage application. Namely, for example, the group of curves 1 represents the relationship between the emission current and the applied voltage which is obtained when the voltage is increased from a point A to a point B and is then decreased to a point C in the first cycle of voltage application as shown in FIG. 4. Similarly, for example, the group of curves 2 represents the relationship between the emission current and the applied voltage which is obtained when the voltage is increased from the point C to a point D through a point B and is then decreased to a point E in the second cycle of voltage application (after the first cycle of voltage application) as shown in FIG. 4.

As can be seen from FIG. 4, in the voltage increase process of each of second and later cycles of voltage application, there exists a voltage at which a bending point is produced on the I-V curve (for example, in the second cycle of voltage application, the point B; in the third cycle of voltage application, the point D; and in the fourth cycle of voltage application, a point F). Each of the cycles of voltage application further includes two kinds of I-V curves along which the applied voltage is varied after having been increased to the bending point. One of the two kinds of I-V curves is an I-V curve along which the voltage applied between the cathode electrode 93 and the anode electrode 95 is varied within the range of voltages not higher than the voltage at the bending point (this I-V curve is called the first curve), and the other is an I-V curve along which the voltage applied between the cathode electrode 93 and the anode electrode 95 continues to be increased within the range of voltages not lower than the voltage at the bending point (this I-V curve is called the second curve). Namely, in FIG. 4, each of the B-C curve, the D-E curve and the F-G curve corresponds to the first curve, while each of the B-D curve and the D-F curve corresponds to the second curve. It can be said, however, that the A-B curve corresponds to the second curve, since there is no applied voltage before the point A. In addition, the second curves of the respective cycles form an approximately continuous line as shown in FIG. 4.

In the n-th (n is an integer greater than or equal to 2) cycle of voltage application, within the voltage range in which the applied voltage varies toward the second line (namely, the bending point in the n-th cycle), the voltage decreasing line of the (n−1)-th cycle and the voltage increasing line of the n-the cycle approximately coincide with each other (are approximately superposed on each other). This fact indicates that the I-V curve has reproducibility within the voltage range in which the applied voltage varies toward the second line, and the reproducibility of the I-V curve is broken (the I-V curve is shifted) by increasing the applied voltage to a further extent after the applied voltage has reached the second line.

The following fact is of far more importance. As compared with the first line obtained after the (n−1)-th (n is an integer greater than or equal to 2) cycle of voltage application has been performed (for example, the B-C line which is an I-V curve having reproducibility and is obtained after the first cycle of voltage application in FIG. 4), the first line obtained after the n-th cycle of voltage application has been performed (for example, the D-E line which is an I-V curve having reproducibility and is obtained after the second cycle of voltage application in FIG. 4) is extended in terms of the range in which the reproducibility of the amount of emission current is obtainable, whereby the first line obtained after the n-th cycle can provide a higher emission current than that obtained after the (n−1)-th cycle.

The above-described nature can be summarized as follows. Namely, electron emission characteristics based on a film comprising a plurality of carbon fibers (an aggregate of a plurality of carbon fibers) typically depend on a maximum applied voltage Vmax experienced by the film comprising a plurality of carbon fibers (for example, in FIG. 4, the voltage value applied at the point B during the first cycle of voltage application, the voltage value applied at the point D during the second cycle of voltage application, and the voltage value applied at the point F during the third cycle of voltage application), and as the maximum applied voltage Vmax is increased, the I-V characteristic is varied (shifted). At the same time, the I-V characteristic that varies in this manner provides a far higher maximum emission current.

Figure 5:
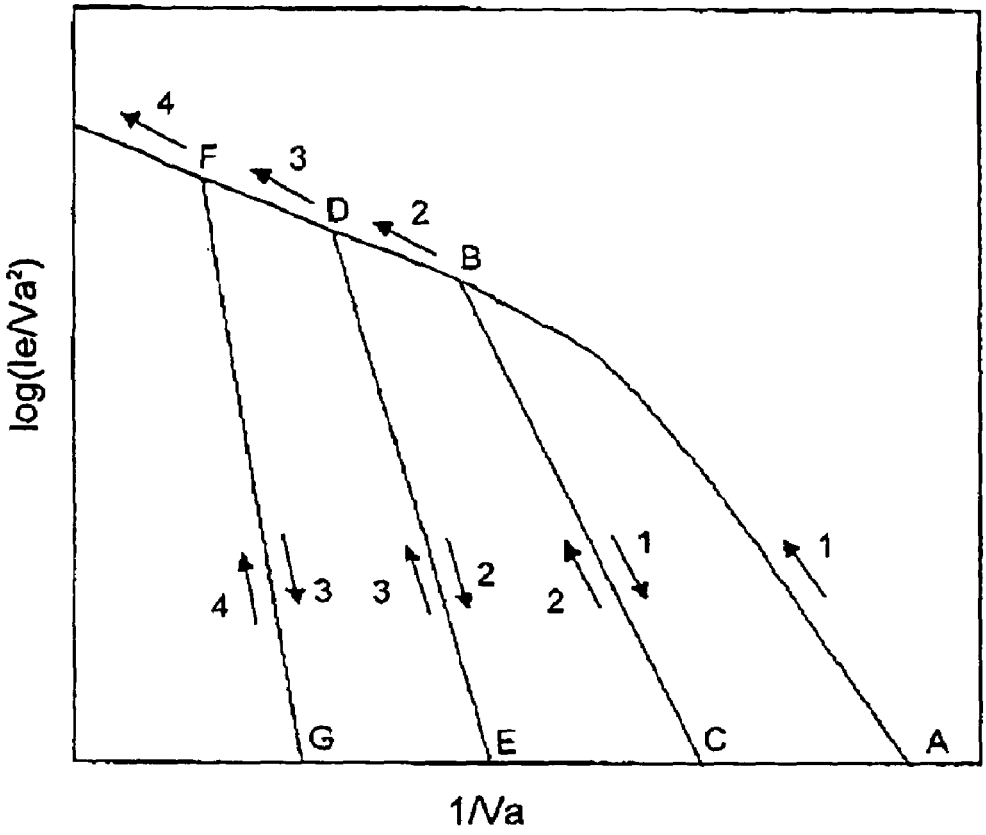
FIG. 5 is a graph showing the F-N characteristic of the electron-emitting device.

FIG. 5 shows F-N (Fowler-Nordheim) plots corresponding to the I-V curves shown in FIG. 4. Points A to G shown in FIG. 5 correspond to the respective points A to G shown in FIG. 4. In the F-N plots as well, it is apparent that there exist bends (the points B, D and F) corresponding to the bends of the I-V curves of the respective drive cycles. From FIG. 5, it can be seen that the inclination of the voltage decreasing process in each cycle of voltage application (for example, the line B-C in the first cycle) negatively increases as the number of cycles of voltage application increases.

An electron emission area $\alpha$ can be found from this inclination and 1/Va-intercept, and a field enhancement factor $\beta$ can be found from the inclination. In this method of calculating from these F-N plots the field enhancement factor $\beta$ and the electron emission area $\alpha$ in the voltage decreasing process of each cycle of voltage application, if voltage application is performed so that the maximum value of the applied voltage increases on a cycle-by-cycle basis, as the number of cycles of voltage application increases, the field enhancement factor $\beta$ decreases, while the electron emission area $\alpha$ increases.

This fact indicates the following. Namely, as V and I are made to coincide with a curve corresponding to the above-described second curve, namely, as the maximum applied voltage Vmax is increased, the value of the field enhancement factor $\beta$ held by the film made of a plurality of carbon fibers (the aggregate of carbon fibers) decreases, while the value of the electron emission area $\alpha$ increases. This fact means that the dynamic range of output current (emission current Ie) can be enlarged by increasing the maximum applied voltage Vmax.

In addition, as the maximum applied voltage Vmax increases, the number of emission sites in the film comprising a plurality of carbon fibers tends to increases. On the other hand, when the applied voltage is varied with the maximum applied voltage Vmax fixed (when the voltage, after the n-th cycle of voltage application, is applied within a voltage range not higher than the maximum applied voltage Vmax applied between the first cycle and the n-th cycle), the locations of the emission sites essentially do not vary, and the quantity of electron emission from the emission sites only increases or decreases according to increases or decreases in the applied voltage. This fact means that locations contributing to electron emission are selected and increased by the increase of the maximum applied voltage Vmax and the resultant emission sites are retained with the maximum applied voltage Vmax fixed (when the voltage, after the n-th cycle of voltage application, is applied within the voltage range not higher than the maximum applied voltage Vmax applied between the first cycle and the n-th cycle). Namely, the increase of the maximum applied voltage Vmax is thought to be accompanied by the destruction of the emission sites and the formation of new emission sites.

As described above in detail, the present inventor has discovered through this experiment 1 that a desired I-V curve can be obtained by executing control to set the maximum applied voltage Vmax to an appropriate value, and has made the invention.

Preferred embodiments of the invention will be specifically described below. In the following description of Embodiments 1 and 2, reference will be made to a driving method for an electron-emitting device using the characteristic (Vmax dependence) peculiar to the aggregate of carbon fibers mentioned in the above-described Experiment 1. More specifically, Embodiment 1 relates to a method of driving an electron-emitting device having a two-terminal structure (diode structure), and Embodiment 2 relates to a method of driving an electron-emitting device having a three-terminal structure (triode structure) Embodiment 3 relates to a manufacturing method capable of reducing, in an electron source having a plurality of electron-emitting devices as well as in an image display apparatus having the same, the difference in characteristic between the plurality of electron-emitting devices by using the above-mentioned Vmax dependence.

(Embodiment 1)

The driving method for an electron-emitting device according to Embodiment 1 of the invention is as shown in FIGS. 1 and 2, and the electron-emitting device used is an electron-emitting device including a two-terminal structure (diode structure) having a cathode electrode and an anode electrode which is spaced upwardly apart from the cathode electrode by a distance H.

Namely, as shown in FIG. 2, the electron-emitting device according to Embodiment 1 is constructed so that a predetermined voltage Va can be applied between the cathode electrode 93 and the counter electrode (the anode electrode) 95 by a voltage source 91. The aggregate 94 of carbon fibers constituting the electron-emitting device is formed on the cathode electrode 93, and the counter electrode 95 is disposed at a position opposite to the cathode electrode 93. The driving method for the electron-emitting device according to Embodiment 1 is to drive the electron-emitting device by applying between the cathode electrode 93 and the counter electrode 95 the maximum voltage applied therebetween by the time instant that the electron-emitting device is to be driven (typically, during the manufacture of the electron-emitting device), namely, the driving voltage V (or a voltage for driving the electron-emitting device) smaller than the maximum applied voltage Vmax experienced by the aggregate 94 of carbon fibers.

In other words, the driving method for the electron-emitting device according to Embodiment 1 is to apply a voltage higher than a voltage to be applied between the cathode electrode 93 and the counter electrode 95 during the driving of the electron-emitting device, to between the cathode electrode and a conductor disposed at a position upwardly remote from the cathode electrode 93 by the distance H, at least once during the manufacture of the electron-emitting device. In yet other words, the driving method is to apply a field strength higher than a field strength to be applied between the cathode electrode 93 and the counter electrode 95 during the driving of the electron-emitting device, to between the cathode electrode and a conductor disposed above the cathode electrode 93, at least once during the manufacture of the electron-emitting device. In yet other words, the driving method is to generate an emission current higher than an emission current to be generated between the cathode electrode 93 and the counter electrode 95 during the driving of the electron-emitting device, from the aggregate 94 of carbon fibers at least once during the manufacture of the same by applying a voltage to a conductor disposed above the cathode electrode 93 (by forming an electric field approximately similar to that generated during the driving).

This driving method is also applicable to a method of driving an electron source in which a plurality of electron-emitting devices of the above-described type are arranged in matrix form. In this case, the driving voltage V and the maximum applied voltage Vmax need only to be set to satisfy the above-described relationship for each of the electron-emitting devices.

Figure 26:
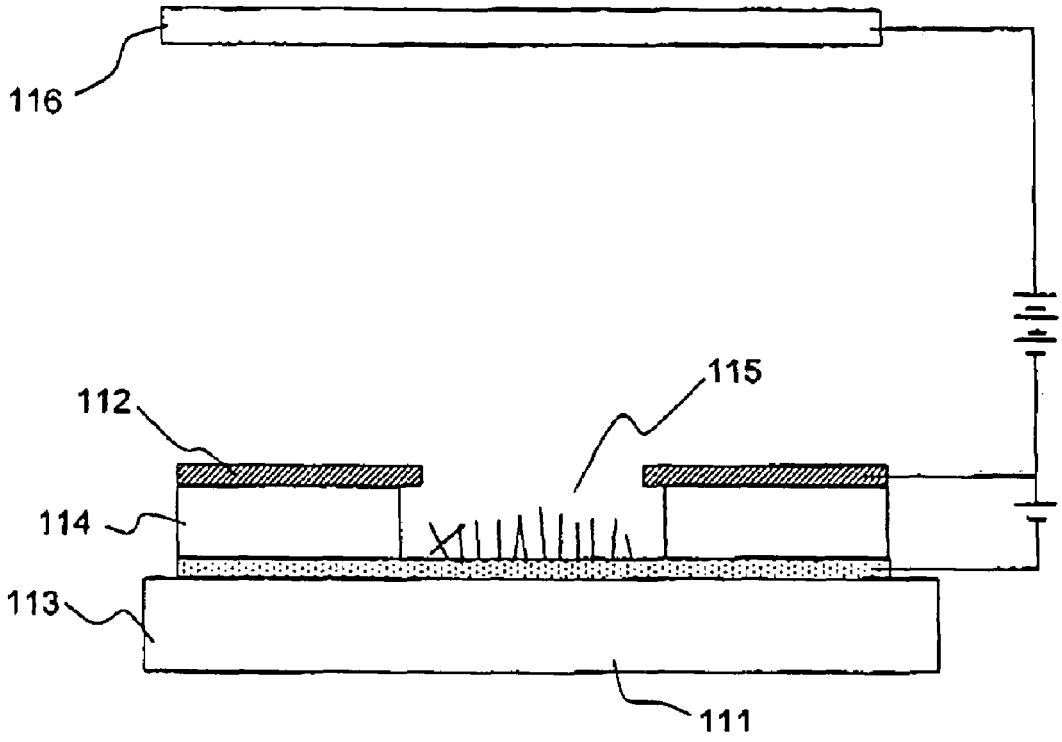
FIG. 26 is a schematic view showing one example of an electron-emitting device.

In addition to the cathode electrode 93 and the counter electrode 95 shown in FIG. 2, a control electrode may be provided for controlling the quantity of electron emission toward the counter electrode 95 from the aggregate 94 of a plurality of carbon fibers (refer to FIG. 26). This construction is included in an electron-emitting device having a three-terminal structure (triode structure) which will be described later in connection with Embodiment 2. However, in Embodiment 1 described above, the field strength generated by the voltage applied between the counter electrode 95 and the cathode electrode 93 is set to not lower than the field strength necessary to extract electrons from carbon fibers, whereby the control electrode is responsible for the role of decreasing the field strength generated by the voltage applied between the counter electrode 95 and the cathode electrode 93. The control electrode is typically responsible for the role of stopping the electron emission from carbon fibers. Even in this electron-emitting device, electron emission of high reproducibility can be obtained in such a way that the driving voltage V to be applied during the driving of the electron-emitting device is set to the voltage range not higher than the maximum applied voltage Vmax.

(Embodiment 2)

An electron-emitting device according to Embodiment 2 will be described below with reference to FIGS. 6A to 7. The electron-emitting device according to Embodiment 2 is an electron-emitting device having a so-called three-terminal structure (triode structure). FIG. 7 is a cross-sectional schematic view showing the state in which the electron-emitting device of Embodiment 2 is driven, and FIG. 6A is a schematic plan view aiding in describing a portion including a cathode electrode 13 and a gate electrode 12, while FIG. 6B is a cross-sectional schematic view taken along line A–A' of FIG. 6A.

The gate electrode 12 and the cathode electrode 13 are disposed on a substrate 11 in the state of being spaced part from each other. An aggregate 14 of carbon fibers disposed on the cathode electrode 13 has one end (denoted by reference numeral 64) which is positioned closer to an anode electrode 62 (refer to FIG. 7) than a surface of the gate electrode 12.

The electron-emitting device according to Embodiment 2 is of the type which starts its first electron emission from the aggregate 14 of carbon fibers when a voltage is applied between the gate electrode 12 and the cathode electrode 13. Namely, the electron-emitting device is of the type in which the potential of the anode electrode 62 substantially does not contribute to the electron emission itself from the aggregate 14 of carbon fibers. Accordingly, in Embodiment 2, the gate electrode 12 corresponds to the counter electrode used in the invention.

Figure 6A:
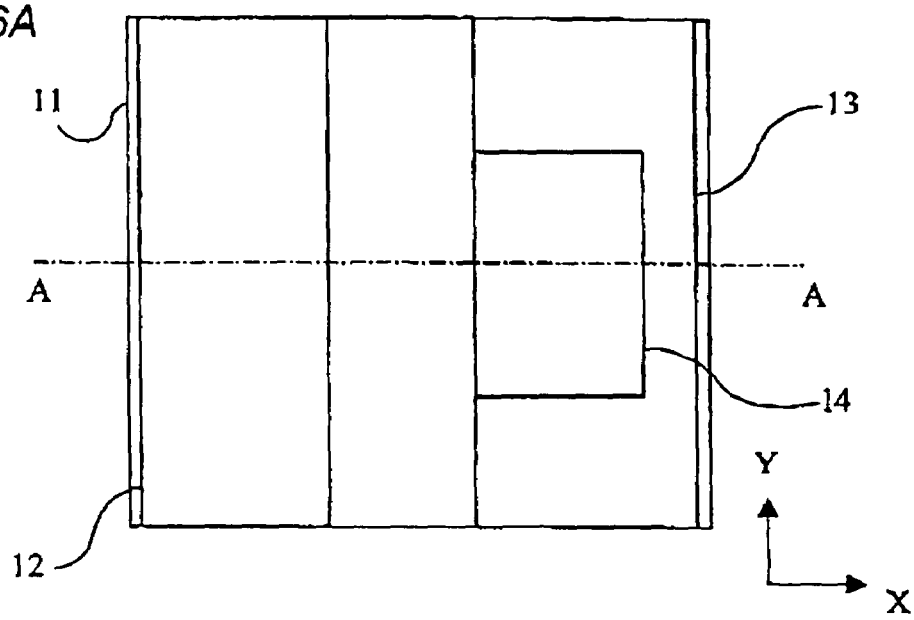
FIG. 6A is a schematic top plan view of the electron-emitting device which uses an aggregate of carbon fibers provided with a gate electrode, as its electron-emitting member.
Figure 6B:
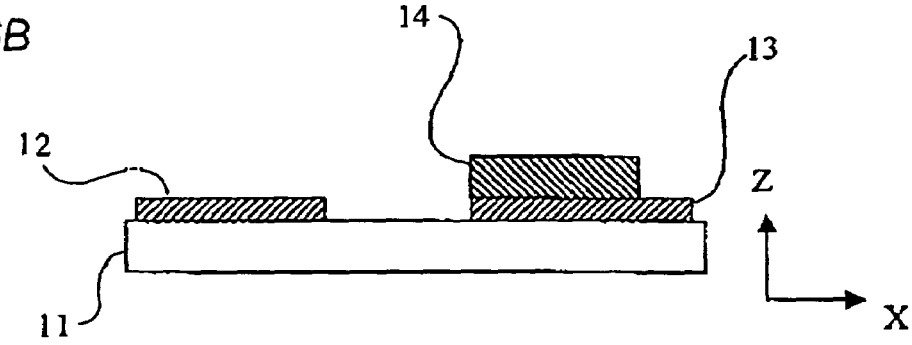
FIG. 6B is a cross-sectional view taken along line A—A of FIG. 6A.
Figure 7:
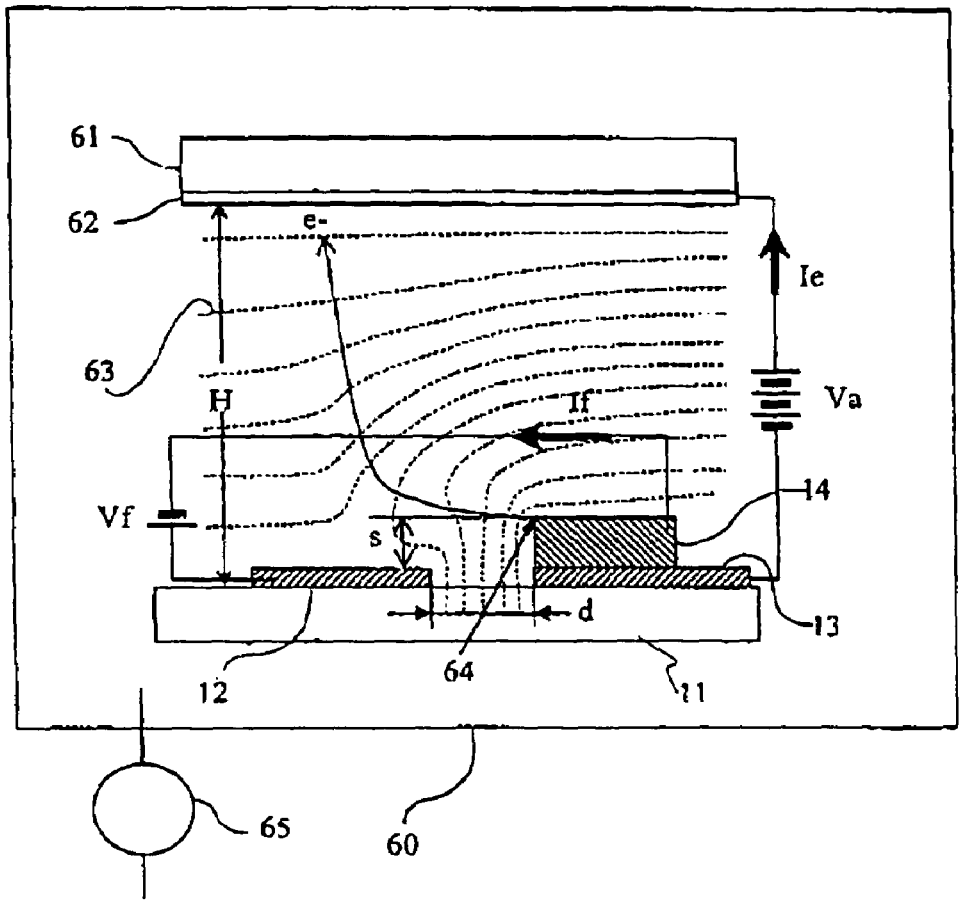
FIG. 7 is a schematic view aiding in describing the state in which electrons emitted from the electron-emitting device move toward an anode electrode.

In FIGS. 6A and 6B, reference numeral 11 denotes an electrically insulative substrate (cathode substrate), reference numeral 12 denotes the gate electrode (extraction electrode), reference numeral 13 denotes a cathode electrode, and reference numeral 14 denotes the aggregate of carbon fibers.

FIG. 7 is a schematic view aiding in describing the state in which when the electron-emitting device according to Embodiment 2 is driven, electrons emitted from the aggregate 14 of carbon fibers are moved toward the anode electrode 62.

In the example shown in FIG. 7, the space "d" between the cathode electrode 13 and the gate electrode 12 is set to, for example, from several μm to several tens of μm, and the electron-emitting device is disposed in a vacuum vessel 60 which is sufficiently evacuated to a pressure of $10^{-4}$ Pa or less by an evacuation unit 65. In the vacuum vessel 60, a substrate 61 having the anode electrode 62 is provided at a height H of 1 to 9 mm from the electrically insulative substrate 11, and a high voltage Va of, for example, 1 to 10 kV is applied to the anode electrode 62 by a high voltage power source (second voltage applying means).

During the driving of the electron-emitting device according to Embodiment 2, while the voltage Va is being applied to the anode electrode 62, a pulse voltage of several tens of V is applied between the cathode electrode 13 and the gate electrode 12 as the driving voltage Vf from a power source which is not shown (first voltage applying means). In this manner, an electric field is formed between the cathode electrode 13 and the gate electrode 12 and electrons are emitted from the aggregate 14 of carbon fibers mainly by the electric field. Then, the electrons emitted reach the anode electrode 62. A driving method for the electron-emitting device according to Embodiment 2 is similar to the method used in Embodiment 1; that is to say, the driving method according to Embodiment 2 is to drive the electron-emitting device by applying between the cathode electrode 13 and the counter electrode the maximum voltage applied therebetween by the first time that the electron-emitting device is driven, namely, a voltage (or a voltage for driving the electron-emitting device) not higher than the maximum applied voltage Vmax experienced by the aggregate 14 of carbon fibers.

In other words, the driving method for the electron-emitting device according to Embodiment 2 is to apply a voltage higher than a voltage to be applied between the cathode electrode 13 and the gate electrode 12 during the driving of the electron-emitting device, between the cathode electrode 13 and the gate electrode 12 at least once before the driving (typically, during the manufacture of the electron-emitting device). In yet other words, the driving method is to apply a field strength higher than a field strength to be applied between the cathode electrode 13 and the anode electrode 62 during the driving of the electron-emitting device, between the cathode electrode 13 and the gate electrode 12 at least once before the driving (typically, during the manufacture of the electron-emitting device). In yet other words, the driving method is to generate an emission current higher than an emission current to be generated between the cathode electrode 13 and the anode electrode 62 during the driving of the electron-emitting device, at least once before the driving (typically, during the manufacture of the same) by applying a voltage between the cathode electrode 13 and the gate electrode 12 (by forming an electric field approximately similar to that generated during the driving).

It is to be noted that, for example, in the case where the field strength necessary to cause electron emission from the aggregate 14 of carbon fibers is low, electron emission may be caused by not only the action of the electric field formed between the gate electrode 12 and the cathode electrode 13 but also the action of the electric field formed between the anode electrode 62 and the cathode electrode 13 (and the gate electrode). Stated in more detail, in such a case, the anode electrode 62 and the gate electrode 12 can be regarded as one electrode which corresponds to the counter electrode used in the invention.

However, typically, if the electron-emitting device is provided with an electrode substantially responsible for the role of extracting electrons from the aggregate 14 of carbon fibers (an electrode other than the cathode electrode 13), that electrode can, of course, be regarded as the above-described counter electrode.

During the driving of the electron-emitting device according to Embodiment 2, If <<Ie is satisfied, where If represents a device current which flows between the electrodes 12 and 13, and Ie represents an emission current which is emitted from the aggregate 14 of carbon fibers and reaches the anode electrode 62.

During the driving of the electron-emitting device according to Embodiment 2, equipotential lines 63 around the electron-emitting device are formed as shown by dotted lines in FIG. 7, and it is considered that a point at which the electric field most highly concentrates is the point 64 of the aggregate 14 of carbon fibers that is closest to the anode electrode 62 and closest to the gap between the cathode electrode 13 and the gate electrode 12. The vicinity of the point 64 at which the electric field is considered to be most highly concentrated is considered to be a main portion from which electrons are emitted. Incidentally, in the case of the electron-emitting device of Embodiment 1 described above with reference to FIGS. 2A and 2B, a point at which the electric field most highly concentrates is considered to be the surface of the aggregate 14 of carbon fibers that is opposed to the anode electrode 62, or the peripheral portion of the aggregate 14 of carbon fibers.

Figure 8:
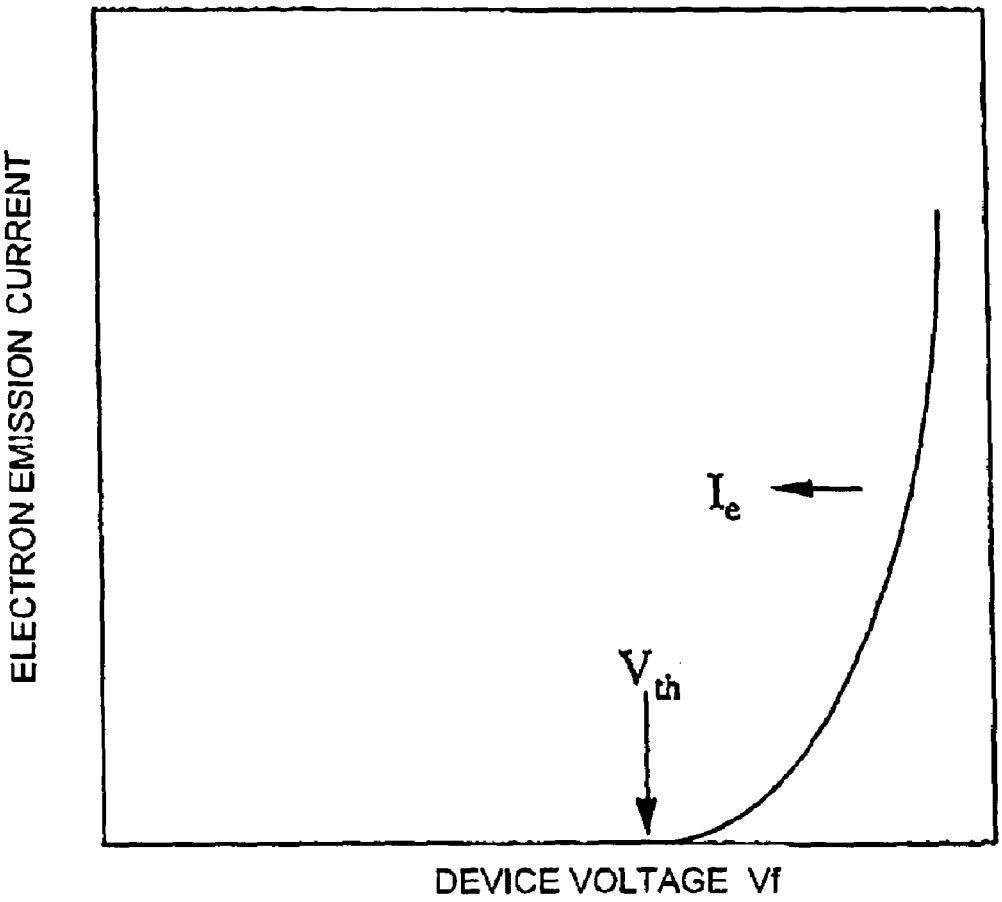
FIG. 8 is a graph showing the Vf-Ie characteristic of the electron-emitting device.

FIG. 8 is a graph showing the Vf-Ie characteristic of the electron-emitting device according to Embodiment 2. In FIG. 8, symbol Vth denotes a voltage at which the emission current Ie starts to be observed while the voltage applied between the cathode electrode 13 and the gate electrode 12 is being gradually increased with the voltage Va applied between the cathode electrode 13 and the anode electrode 62. It is to be noted that the Vf-Ie characteristic of the electron-emitting device according to Embodiment 1 is also shown by a graph similar to FIG. 8. However, in the case of Embodiment 1, the voltage Vth is a voltage at which the emission current Ie starts to be observed while the voltage applied between the cathode electrode 93 and the anode electrode 95 is being gradually increased.

Figure 9:
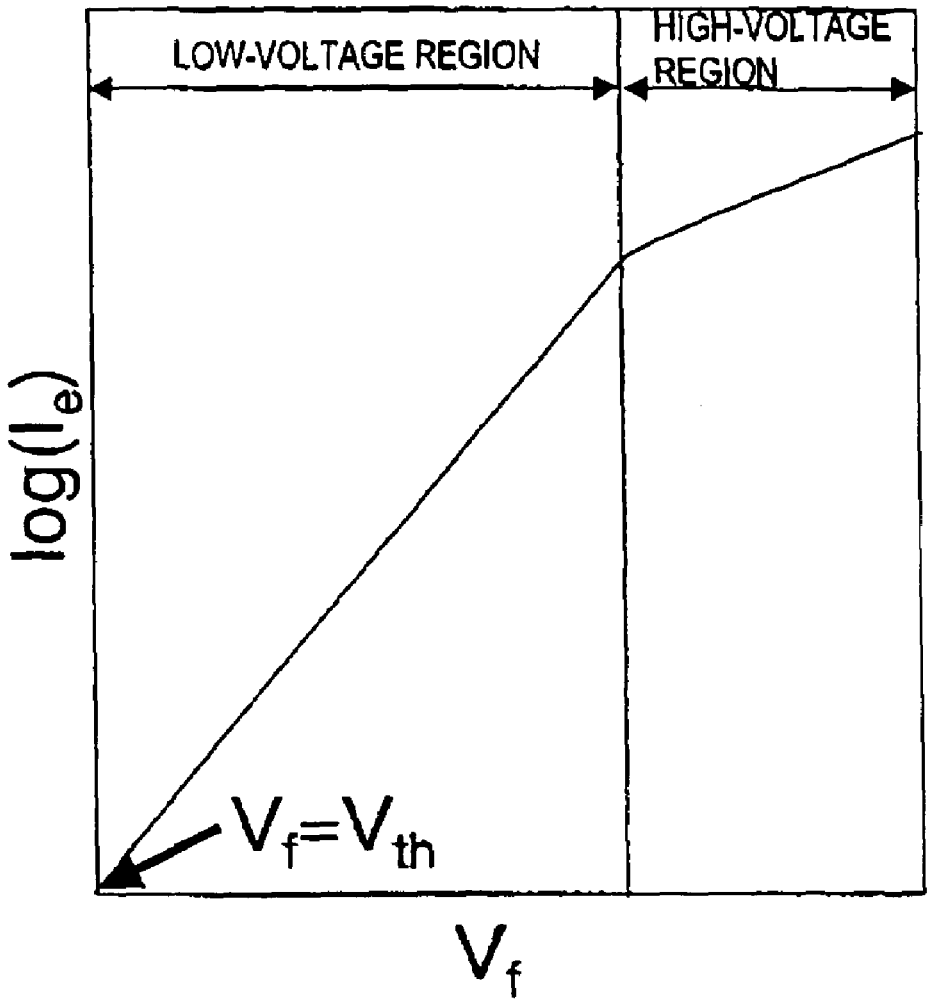
FIG. 9 is a graph showing the Vf-log(Ie) characteristic of the electron-emitting device.

FIG. 9 is a graph showing the Vf-Ie characteristic obtained in an area of Vf>Vth when the emission current Ie plotted against the vertical axis of the graph of FIG. 8 is expressed by a logarithmic representation (log(Ie)). The electron-emitting device according to Embodiment 1, therefore, shows a characteristic similar to that shown in FIG. 9.

It is known that the emission current density in a field emission from a tip of a metal into a vacuum obeys a relation called the Fowler-Nordheim equation whose parameters are the electric field at the tip of an emitter that is expressed by Poisson's equation and the work function of the emitter. From the Fowler-Nordheim equation, it is concluded that $\log(Ie/Vf^2)$ and 1/Vf have a linear relationship, and a field enhancement factor and the like are obtained from the inclination of the linear line.

From this fact, if an actual electron emission characteristic is plotted (F-N plots) in a graph in which $\log(Ie/Vf^2)$ is set to the vertical axis and 1/Vf is set to the horizontal axis, it can be determined whether the relationship between current and voltage has been obtained depending on field emission, by determining whether the obtained graph obeys the linear relationship.

However, in the case where the electron-emitting portion of the electron-emitting device is an aggregate of carbon fibers as in the invention, $\log(Ie/Vf^2)$ and 1/Vf do not necessarily obey one linear relationship, depending on the upper limit of the applied voltage Vf (the inclination of a line drawn by the F-N plots in the graph does not become constant).

Figure 10:
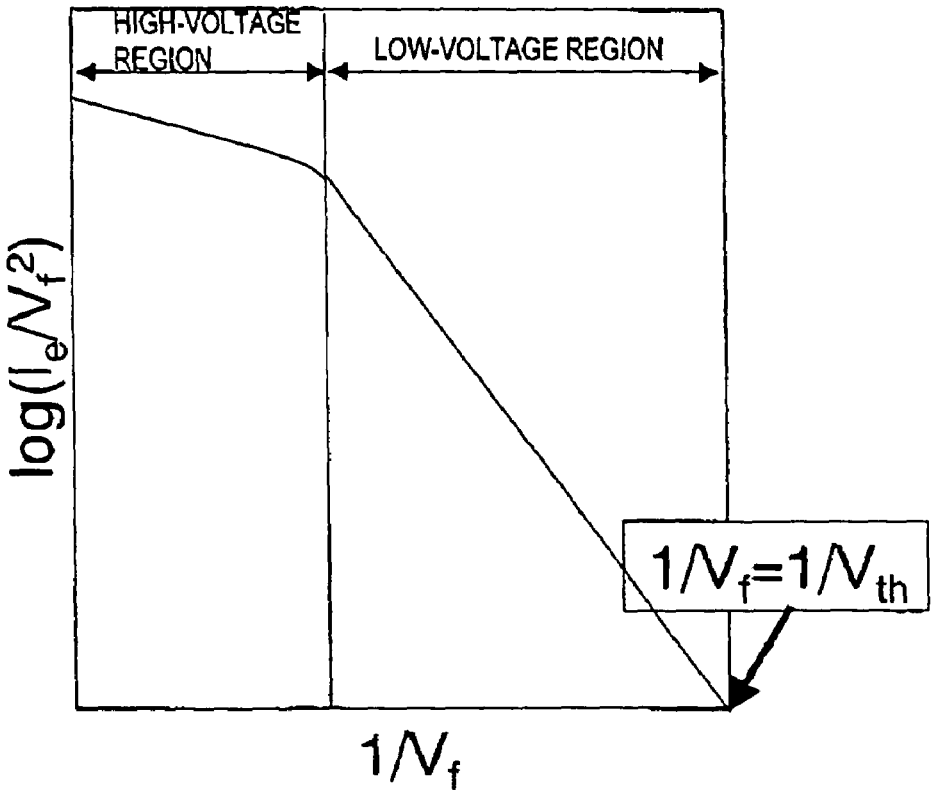
FIG. 10 is a graph showing the 1/Vf-log(Ie/Vf$^2$) characteristic of the electron-emitting device.

FIG. 10 is a graph showing $\log(Ie/Vf^2)$ and 1/Vf plots as to the above-described electron emission characteristic, shown in FIG. 9, of the aggregate of carbon fibers according to Embodiment 2. As shown in FIG. 10, the voltage range Vf>Vth, which is accompanied by the occurrence of emission current, is divided into two regions according to the behavior of $\log(Ie/Vf^2)$ with respect to 1/Vf; that is to say, 1. a low-voltage region: region where $\log(Ie/Vf^2)$ approximately linearly behaves, and 2. a high-voltage region: region where $\log(Ie/Vf^2)$ behaves with the amount of variation that is expressed by a small absolute value compared to the absolute value of the amount of variation of $\log(Ie/Vf^2)$ in the low-voltage region.

Figure 11:
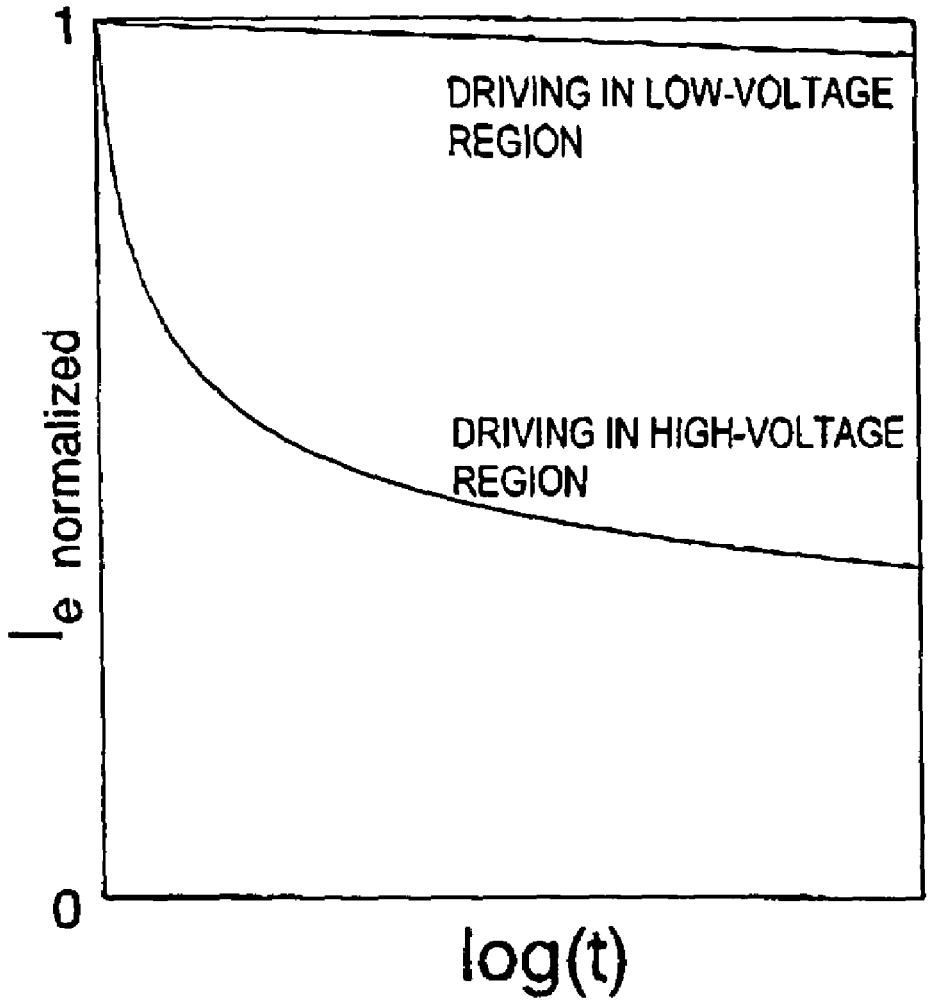
FIG. 11 is a graph showing the log(t)-Ie (normalized) characteristic of the electron-emitting device.

The two regions have the following characteristics shown in FIG. 11. FIG. 11 is a graph showing temporal variations in the emission current Ie which are respectively caused when the driving voltage Vf is applied in the low-voltage region and in the high-voltage region.

Namely, in the driving of the electron-emitting device at a constant voltage in the low-voltage region, several tens of hours of driving merely causes a 1% or less degradation of the emission current and hardly causes variations in the electron emission characteristic, so that reproducibility is high.

However, in the driving of the electron-emitting device at a constant voltage in the high-voltage region, the attenuation of the emission current is intense, so that several tens of minutes of driving causes a 10% or more decrease in the emission current.

The electron emission characteristics shown in FIGS. 8, 9 and 10 are respectively represented by curves each obtained from a monotonous increase in the applied voltage.

The irreversibility of the electron emission characteristic of the electron-emitting device according to Embodiment 2 will be described below in detail. In the case where three applied voltages $V_{f1}$, $V_{f2}$ and $V_{f3}$ are prepared to satisfy the relationship of $V_{f2}>V_{f1}$ and $V_{f2}>V_{f3}$, if the applied voltage and the emission current are increased and decreased in the order of $(V_{f1}, I_{e1})$, $(V_{f2}, I_{e2})$ and $(V_{f3}, I_{e3})$, the relationship between Vf and log(Ie) is plotted along curves similar to those shown in FIG. 1 mentioned previously.

Figure 12:
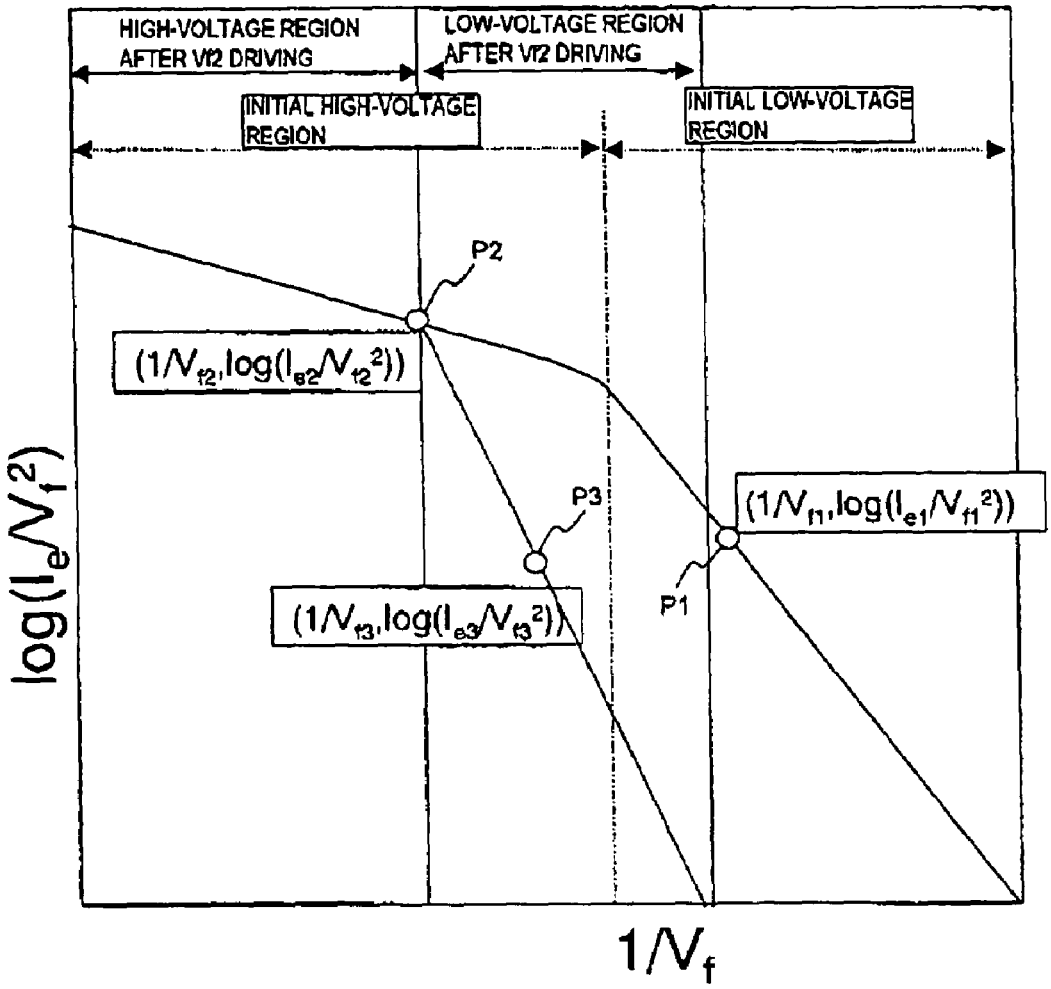
FIG. 12 is a graph showing the 1/Vf-log(Ie/Vf$^2$) characteristic, aiding in describing the irreversible characteristic of the electron-emitting device according to Embodiment 2.

If the plots of the data in FIG. 1 are modified to draw curves along which the relationship between 1/Vf and $\log(Ie/V_f^2)$ (the I-V characteristic) is plotted, the curves shown in FIG. 12 are obtained.

For example, while the electron-emitting device is being driven with the voltage $V_{f1}$ and the current $I_{e1}$, if this driving voltage $V_{f1}$ is increased, the I-V characteristic bends at an intermediate point.

When the driving voltage is not higher than that at this bending point, the driving voltage is in an initial low-voltage region, and the I-V characteristic in this region has reproducibility.

After the driving voltage enters an initial high-voltage region through this bending point, if the driving voltage continues to be increased, the I-V characteristic continues to increase in only one direction as shown in FIG. 12.

At a point P2 corresponding to the voltage $V_{f2}$ and the current $I_{e2}$, the increase of the driving voltage is stopped. Then, when the electron-emitting device is driven at a voltage value lower than the voltage $V_{f2}$, the I-V characteristic does not draw the curve that passes through the bending point between the point P1 and the point P2, and assumes the form shown by the curve drawn between a point P3 and the point P2. The I-V characteristic shown by the curve between the point P3 and the point P2 has reproducibility so long as the applied voltage does not exceed the voltage $V_{f2}$.

After that, when the applied voltage is further increased beyond the voltage $V_{f2}$, the I-V characteristic draws a curve containing the bending point P2.

In this manner, the I-V characteristic of the electron-emitting device having the aggregate of carbon fibers varies as the maximum applied voltage in the history of applied voltages increases. However, so long as the applied voltage does not exceed the maximum applied voltage, the I-V characteristic substantially does not vary.

In brief, a threshold voltage which divides the initial low-voltage region and the initial high-voltage region shifts with an increase in the maximum applied voltage, and letting $V_{f2}$ denote the maximum applied voltage experienced in the past, a low-voltage region and a high-voltage region both of which are to be obtained after driving with the maximum applied voltage $V_{f2}$ are obtained in the state of being divided from each other at the point P2.

Namely, each time an increase and a decrease in the applied voltage are repeated to update the past maximum applied voltage, the electron emission characteristic varies, and not only an electron emission threshold but also the bend of the electron emission characteristic that divides the low-voltage region and the high-voltage region irreversibly varies. Accordingly, if the history of the past applied voltages is unknown, it is preferable to increase gradually the applied voltage until the bending point appears, and then select a driving voltage from a voltage range not higher than the maximum applied voltage, thereby driving the electron-emitting device at the selected driving voltage.

The electron-emitting device using the aggregate of carbon fibers according to this invention has the following feature as to its characteristics. Namely, once the aggregate of carbon fibers experiences a voltage in the high-voltage region, the electron emission characteristic cannot return to the original low-voltage region, but a newly updated low-voltage region contains a current range which is extended to a current value corresponding to the voltage value experienced by the aggregate of carbon fibers in the high-voltage region.

Specifically, referring to FIGS. 1 and 12, the upper limit of the low-voltage region is $V_{f2}$, which is obtained after the applied voltage has entered the high-voltage region from the voltage $V_{f1}$ and the aggregate of carbon fibers has experienced the voltage $V_{f2}$ in the high-voltage region, and a current value corresponding to the upper limit of this high-voltage region is $I_{e2}$.

Once the aggregate of carbon fibers has experienced driving at the voltage $V_{f2}$, a new low-voltage region is determined as shown in FIG. 1. At this time, the upper limit of the low-voltage region is $V_{f2}$ which is obtained after the aggregate of carbon fibers has experienced driving at the voltage $V_{f2}$, and the current region of the low-voltage region is extended to the corresponding current $I_{e2}$.

Actually, if the electron-emitting device is to be used in various applications, the emission current needs to be controlled with good reproducibility by a voltage applied to the electron-emitting device during the driving thereof. Accordingly, it is desired that the electron-emitting device be driven in a low-voltage region which has reproducibility and satisfies an approximately linear relationship in terms of plots of $\log(Ie/Vf^2)$ and 1/Vf (F-N plots) Accordingly, a current range capable of being outputted in such low-voltage region is the dynamic range of the electron-emitting device.

This fact indicates that the application of the voltage $V_{f2}$ makes it possible to widen the dynamic range of the electron-emitting device, compared to the initial driving period thereof.

Namely, it is considered that while the electron-emitting device is being driven in the low-voltage region, an irreversible variation in the electron emission characteristic is substantially absent or nearly negligible, but while the electron-emitting device is being driven in the high-voltage region, a non-negligible, irreversible variation occurs in a local shape and/or the electron emission characteristic of the aggregate of carbon fibers.

Because of such a characteristic, when the electron-emitting device is to be driven for a long time for practical purposes such as displaying, it is not preferable to drive the electron-emitting device in the high-voltage region, because current degradation is caused by driving in the high-voltage region.

Accordingly, to maintain a stable emission current, it is preferable to drive the electron-emitting device in the low-voltage region lower than the maximum applied voltage Vmax, as described previously.

During practical driving such as displaying, if an objective driving current value is above the upper limit of the low-voltage region, it is preferable to temporarily apply a voltage not lower than any voltage contained in the high-voltage region where the objective driving current value can be obtained, in the opposite way to the above-described driving method according to the invention. Namely, a voltage (Vmax) higher than the maximum applied voltage obtained in the history of the past applied voltages is applied to widen the dynamic range of the electron-emitting device, and then the electron-emitting device is driven at a driving voltage lower than the voltage Vmax.

In this manner, a current range corresponding to a newly obtained low-voltage region can be extended to a region above an objective driving current. Accordingly, the electron-emitting device can be driven with the objective driving current in a low-voltage region where a temporally more stable driving state can be realized.

Embodiment 3 of the invention which will be described later reduces the difference in electron emission characteristic between a plurality of electron-emitting devices by making use of the fact that the electron emission characteristic of the aggregate of carbon fibers can be shifted, thereby providing an electron source of high uniformity.

One example of a manufacturing method for the electron-emitting device used in the invention will be described below. In the following description, reference will be made to an example of a lateral type of electron-emitting device such as that described previously in connection with Embodiment 2 and shown in FIG. 6. However, the invention can also be used in a so-called vertical type of electron-emitting device such as that shown in FIG. 26. Incidentally, as compared with the vertical type of electron-emitting device, the lateral type of electron-emitting device has a preferable form in that the lateral type is easy to manufacture and can be driven at high speeds because its capacitance components are small for driving.

The term "lateral type of electron-emitting device" indicates an electron-emitting device of the type which forms an electric field in a direction substantially parallel to the surfaces of its substrates and extracts electrons from its aggregate of carbon fibers by means of the electric field. The term "vertical type of electron-emitting device" indicates an electron-emitting device of the type which forms an electric field in a direction substantially perpendicular to the surfaces of its substrates and extracts electrons from its aggregate of carbon fibers by means of the electric field. The vertical type of electron-emitting device includes a so-called Spindt type of electron-emitting device.

The vertical type of electron-emitting device shown in FIG. 26 includes a cathode electrode 113 and a control electrode 112 (a so-called triode (three-terminal) structure which includes an anode electrode 116 in addition to the electrodes 113 and 112). Since an aggregate 115 of carbon fibers is capable of emitting electrons at a low field strength, the invention is also applicable to a vertical type of electron-emitting device having a structure in which the control electrode 112 and the electrically insulating layer 114 shown in FIG. 26 are omitted (refer to FIG. 2). Namely, the invention is also applicable to an electron-emitting device which includes the cathode electrode 113 disposed on a substrate 111 and the aggregate 115 of carbon fibers disposed on the cathode electrode 113 (a so-called diode (two-terminal) structure which includes the anode electrode 116 in addition to the cathode electrode 113) (refer to FIG. 2).

In the above-described triode structure, as shown in FIG. 26, the control electrode 112 may be made to function as a so-called gate electrode (an electrode for extracting electrons from the aggregate 115 of carbon fibers), but since the aggregate 115 of carbon fibers can emit electrons at a low field strength, the anode electrode 116 may be made to perform extraction of electrons from the aggregate 115 of carbon fibers, and the control electrode 112 may also be used for effecting modulation of the quantity of electron emission from the aggregate 115 of carbon fibers and stoppage of electron emission from the same, or effecting shaping such as convergence of emitted electron beams. In this case, the anode electrode 116 serves as a counter electrode.

The following example is merely one example, and the manufacturing method according to the invention is not limited to only the following example. In the description of the following example, reference will be made to an example of a manufacturing method for the electron-emitting device of three-terminal structure shown in FIGS. 6A, 6B and 7.

(Step 1)

First, a substrate whose surfaces are sufficiently cleaned is prepared as the electrically insulative substrate 11. The substrate is selected from among materials such as silica glass, PD200 glass, glass which is decreased in the content of impurities such as Na and is partly substituted by k, soda-lime glass, a stacked structure in which a layer of $SiO_2$ is stacked on a silicon substrate or the like, and ceramics such as alumina.

(Step 2)

The gate electrode (control electrode) 12 and the cathode electrode 13 are formed on the electrically insulating substrate 11 by a general deposition technique such as evaporation or sputtering and a general patterning technique such as photolithography. The material of the gate electrode 12 and the cathode electrode 13 may be appropriately selected from among, for example, metals, metal nitrides, metal carbides, metal borides, semiconductors, and metallic compounds of semiconductors. The thickness of each of the gate electrode 12 and the cathode electrode 13 is preferably set within the desired range of resistance values, for example, within the range of 10 nm to 100 μm.

Particularly in the case where carbon fibers are to be grown by CVD with a catalyst as will be described later, it is preferable that a film of metal nitride be disposed between the cathode electrode 13 and the carbon fibers in order to stabilize the growth of the carbon fibers. For example, TiN is preferably used as the metal nitride.

(Step 3)

The aggregate 14 of carbon fibers is disposed on the cathode electrode 13. The carbon fibers preferably use graphite nanofibers, and structures such as "herring-bone" and "platelet" or combined forms of these structures may be used as the graphite nanofibers.

Through the above-described steps, the electron-emitting device having such aggregate of carbon fibers can be formed. During actual driving, the electron-emitting device can obtain an electron emission characteristic of high reproducibility by being driven within the above-described voltage range not higher than the maximum applied voltage Vmax.

Incidentally, carbon fibers usable in the invention are, in addition to graphite nanofibers, carbon nanotubes, carbon nanohorns having structures like carbon nanotubes with closed tip ends, amorphous carbon fibers, and the like. Basically, the carbon fibers usable in the invention are electrically conductive. In addition, preferably, any of these carbon fibers has a nano-order diameter (not smaller than 1 nm and smaller than 1,000 nm, preferably, not smaller than 5 nm and not greater than 100 nm).

Figure 24A:
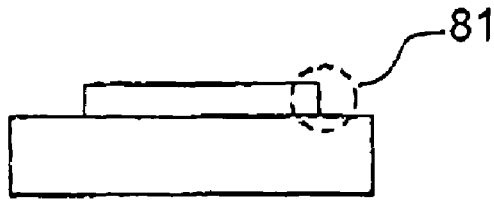
FIGS. 24A to 24C are schematic views showing one example of the form of carbon fibers.
Figure 24B:
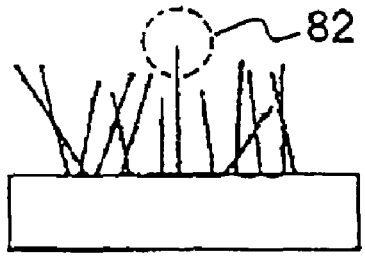
Figure 24C:
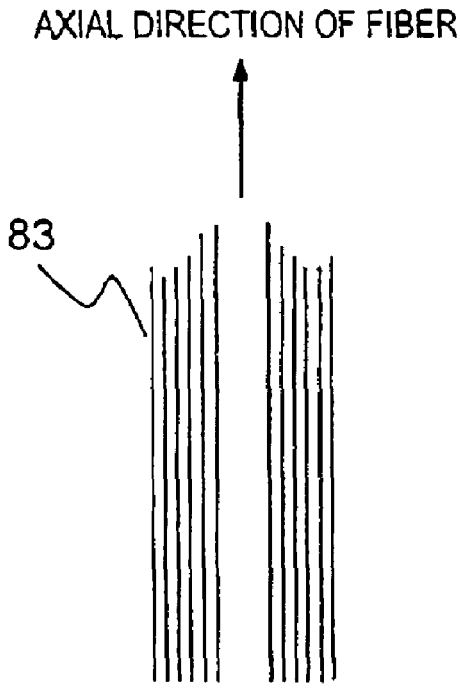
Figure 25A:
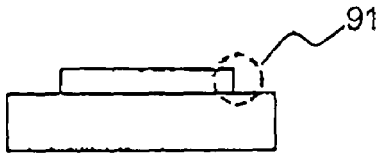
FIGS. 25A to 25D are schematic views showing another example of the form of carbon fibers.
Figure 25B:
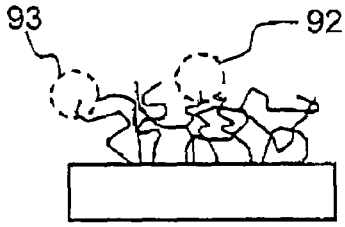
Figure 25C:
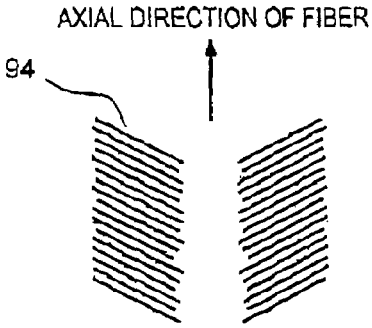
Figure 25D:
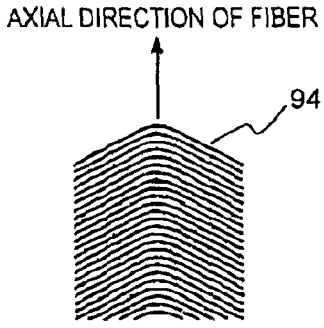

Examples of different forms of the above-described carbon fibers are respectively shown in FIGS. 24A, 24B and 24C and FIGS. 25A, 25B, 25C and 25D. FIGS. 24A and 25A show forms visible at the level of an optical microscope (−1,000 magnifications). FIGS. 24B and 25B are, respectively, partial enlarged views of portions 81 and 91 of FIGS. 24A, 25A and show forms visible at the level of a scanning electron microscope (SEM) (−30,000 magnifications). FIG. 24C and FIGS. 25C and 25D are, respectively, partial enlarged views of FIGS. 24B and 25B (FIG. 24C is a partial enlarged view of a portion 82 of FIG. 24B and FIGS. 25C and 25D are, respectively, partial enlarged views of portions 92 and 93 of FIG. 25B, and FIGS. 24C, 25C and 25D schematically show different forms of carbons visible at the level of a transmission electron microscope (TEM) (−1,000,000 magnifications.) In these figures, reference numerals 83 and 94 denote graphenes.

A structure in which the graphenes 83 assume a cylindrical form as shown in FIGS. 24A to 24C is called "carbon nanotube". In other words, in the case where graphenes are disposed to surround the axial direction of a carbon fiber (in a cylindrical form), this carbon fiber is called "carbon nanotube". In yet other words, the carbon fiber is a carbon fiber having a structure in which a plurality of graphenes are disposed substantially in parallel with the axis of the carbon fiber. A nanotube made of a multiplicity of cylinders constituting a multiple structure is called "multi-wall nanotube", while a nanotube made of one cylinder is called "single-wall nanotube". Particularly in a nanotube having a structure opened at its tip end, the threshold electric field required for electron emission decreases to the maximum extent.

A carbon fiber made of the stacked graphenes 94 as shown in FIGS. 25A to 25D is called "graphite nanofiber". More specifically, the graphite nanofiber is a carbon fiber in which graphenes are stacked in its longitudinal direction (in the axial direction of the fiber). In other words, the graphite nanofiber is a carbon fiber in which a plurality of graphenes disposed in non-parallel with the axis of the carbon fiber are stacked as shown in FIGS. 25A to 25D. Typically, in the herring-bone type, the angle formed by the axis of the carbon fiber and each sheet of graphene is in the range of 30 to 90 degrees. In the case where graphenes have a planar shape and the c axis thereof extends along the axial direction of a carbon fiber (typically, the angle formed by the axis of the carbon fiber and each sheet of graphene is 90 degrees), this structure is called "platelet". A structure in which graphenes are bent in a V-like shape and the V-like shaped graphenes are stacked in the axial direction of a carbon fiber (refer to FIG. 25D) is called "herring-bone". In addition, a structure in which graphenes each having a conical shape (specifically, a conical shape which does not at least have a portion corresponding to the bottom of a cone) are stacked in the axial direction of a carbon fiber is one kind of herring-bone structure. Further, a structure in which graphenes each having a conical shape in which a tip portion is omitted from the conical shape of the above-described graphene (a conical shape having neither the bottom nor the tip end) are stacked in the axial direction of a carbon fiber (refer to FIG. 25C) is one kind of herring-bone structure.

Incidentally, one sheet of graphite is called "graphene" or "graphene sheet". More specifically, graphite is a structure in which carbon sheets each including regular hexagons, each of which is disposed adjacently to the neighboring ones and is formed by carbon atoms covalently bonded by $sp^2$-hybridization, are stacked (ideally, stacked with a distance of 3.354 Å held between carbon sheets). Each of such carbon sheets is called "graphene" or "graphene sheet".

The above-described graphite nanofiber has an electron emission characteristic easy to control through Vmax control, compared to the carbon nanotube. For this reason, in a multi-electron source in which a multiplicity of electron-emitting devices using aggregates of carbon fibers are disposed, the use of graphite nanofibers makes it easy to adjust the electron emission characteristics of individual electron-emitting devices. Accordingly, in an image display apparatus as well as such a multi-electron source, it is far more preferable to employ aggregates of carbon fibers including only graphite nanofibers, or aggregates of carbon fibers mainly containing graphite nanofibers.

A method of disposing the aggregate 14 of carbon fibers on the cathode electrode 13 may make use of known manufacturing methods. For example, the aggregate 14 of carbon fibers can be disposed on the cathode electrode 13 by the method of applying a paste containing carbon fiber formed previously or a dispersion liquid of carbon fiber formed previously to the cathode electrode 13, and then removing unnecessary components. Otherwise, a multiplicity of carbon fibers can be formed on the cathode electrode 13 by the method of disposing a catalyst (preferably, catalyst particles) on the cathode electrode 13 and effecting a CVD process in an atmosphere containing a carbon-containing gas.

Materials which constitute the catalyst for growing carbon fiber may make use of Fe, Co, Ni and Pd or alloys of these metals, and in terms of electron emission characteristics, it is particularly preferable to use an alloy of Pd and Co as the catalyst.

Pd and Ni in particular are capable of forming graphite nanofiber at low temperatures (temperatures not lower than 400° C.) The formation temperature of carbon nanotubes using Fe and Co needs to be 800° C. or more, but the formation of graphite nanofiber materials using Pd and Ni is possible at such low temperatures and is preferable in terms of influences on other members and manufacturing costs.

In addition, by employing the characteristics of Pd which allow its oxides to be reduced by hydrogen at low temperatures (room temperature), it is possible to employ palladium oxide as a general nucleus formation material.

If the hydrogen reduction of palladium oxide is performed, it is possible to form initial aggregation nuclei at comparatively low temperatures (not higher than 200° C.) without using the thermal aggregation of metal thin film that has heretofore been used as general nucleus formation techniques, nor the formation and evaporation of ultrafine particles.

The above-described carbon-containing gas may make use of, for example, hydrogencarbon gases such as ethylene, methane, propane and propylene, CO or $CO_2$ gases, or vapors of organic solvents such as ethanol and acetone.

Through the above-described steps, the electron-emitting device having the aggregate 14 of carbon fibers can be formed.

Figure 13:
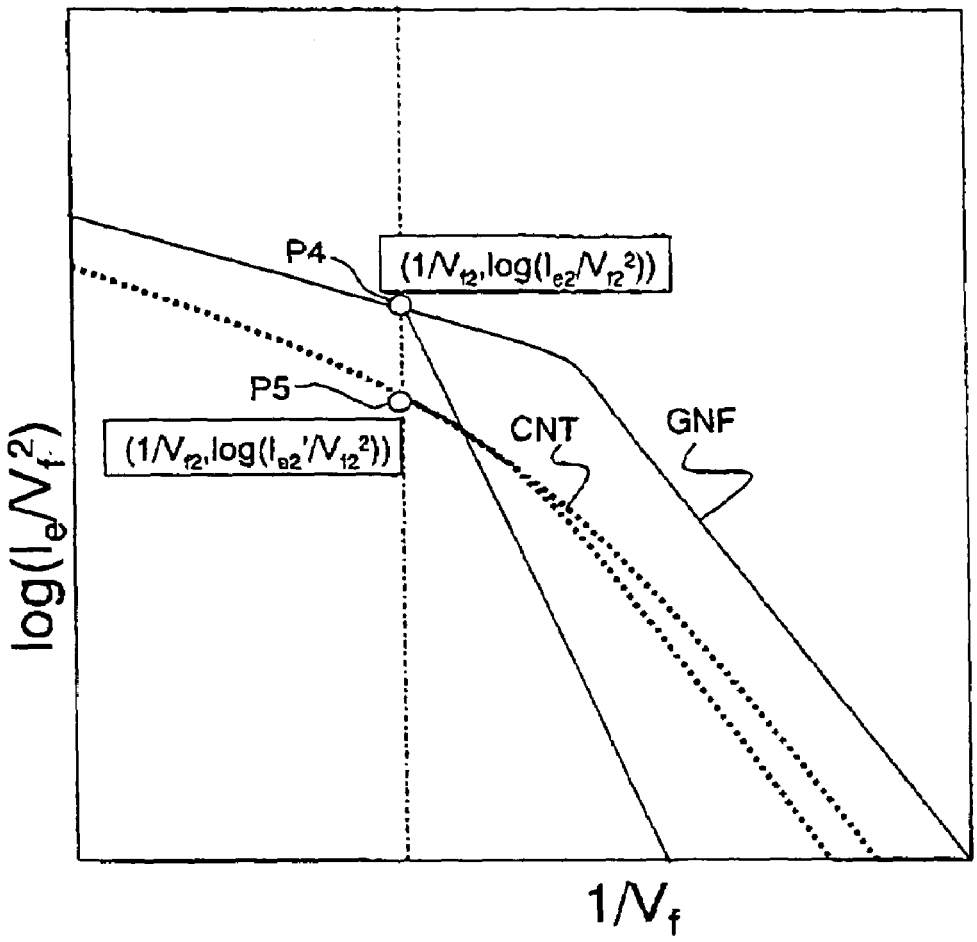
FIG. 13 is a graph showing the 1/Vf-log(Ie/Vf$^2$) characteristic of an electron-emitting device using carbon nanotubes (CNT) and graphite nanofibers (GNF) as its electron-emitting member.

The variation and reproducibility of the electron emission characteristic due to the application of the above-described maximum applied voltage Vmax are observed more remarkably clearly in graphite nanofibers than in carbon nanotubes. This state is shown in FIG. 13. FIG. 13 is a graph comparatively showing the $1/Vf\text{-}\log(Ie/Vf^2)$ characteristics of different electron-emitting devices which respectively use carbon nanotubes (CNT) and graphite nanofibers (GNF) as their electron-emitting materials.

In the graphite nanofibers, it can be seen that the low-voltage region obtained after $Vf=Vf_2$ has been applied shifts remarkably compared to the initial low-voltage region. On the other hand, in the carbon nanotubes, the amount of shift of the electron emission characteristic is small compared to the graphite nanofibers, but a shift of the electron emission characteristic is effected.

(Embodiment 3)

In the following description of Embodiment 3 of the invention, reference will be made to a method of driving an electron source in which a multiplicity of electron-emitting devices each having the above-described type of aggregate of carbon fibers are arranged, and to a manufacturing method (characteristic adjusting method) which reduces the difference in electron emission characteristic between individual electron-emitting devices.

Figure 14:
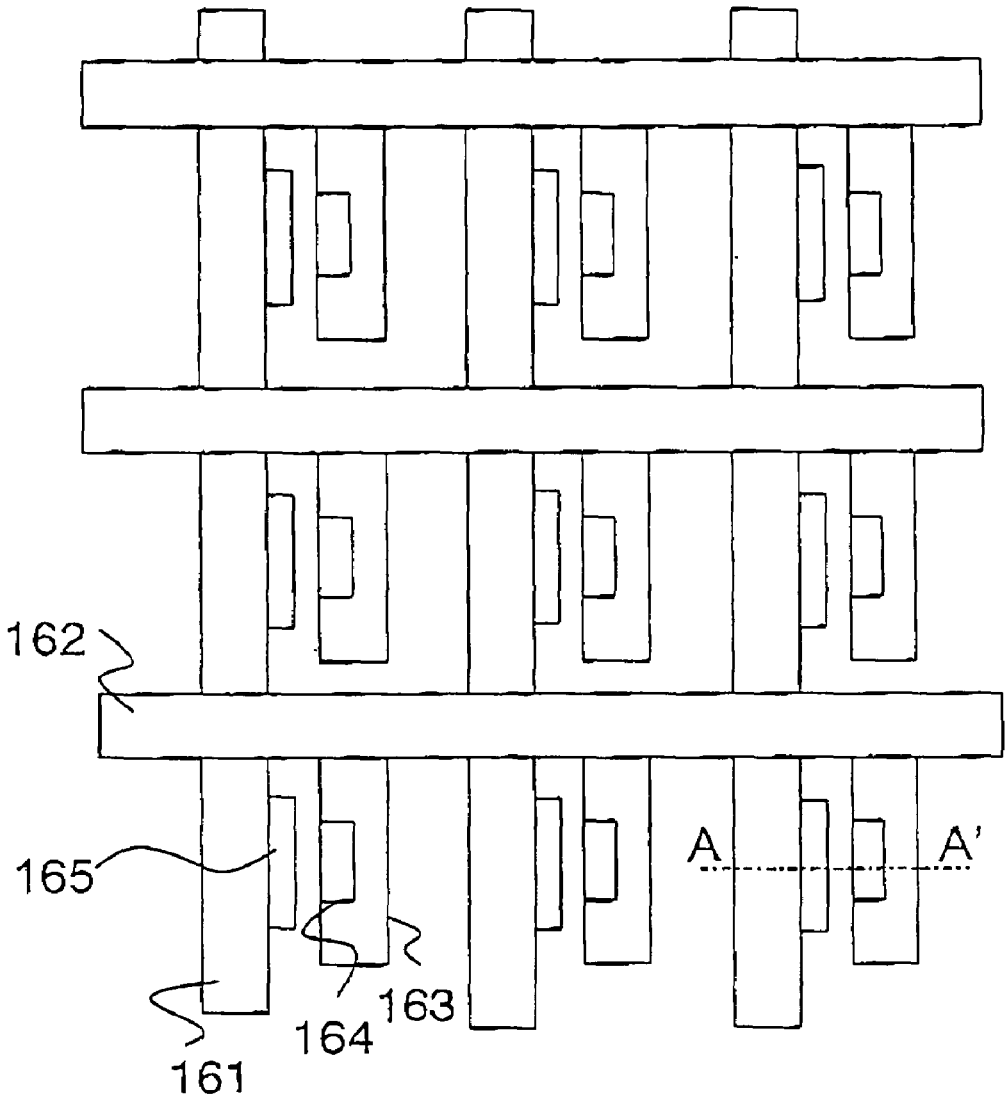
FIG. 14 is a schematic plan view of a multi-electron source in which electron-emitting devices are disposed in matrix form.
Figure 15:
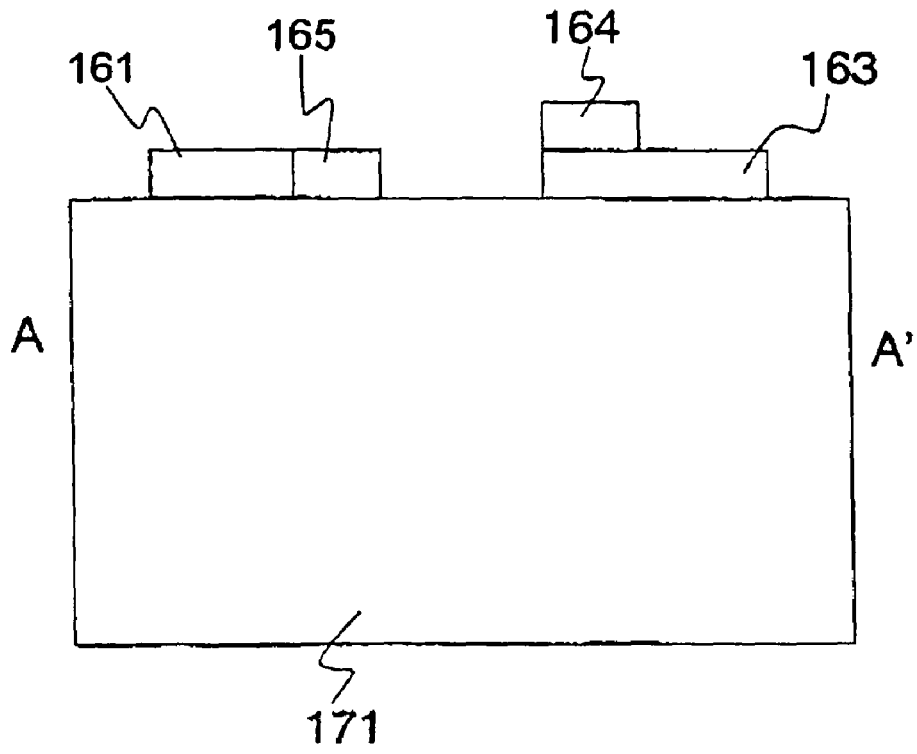
FIG. 15 is a cross-sectional view of the multi-electron source, taken along line A–A' of FIG. 14.

FIG. 14 shows one example of an electron source in which a multiplicity of electron-emitting devices fabricated by the above-described method are disposed in matrix form. FIG. 15 is a schematic cross-sectional view taken along line A–A' of FIG. 14.

The form of arrangement of electron-emitting devices according to the invention is not limited to only that shown in FIG. 14.

In the example shown in FIG. 14, a column wiring 161 electrically connected to the gate electrode 165 (corresponds to the member denoted by reference numeral 12 in FIGS. 6 and 7) of one of the electron-emitting devices. A row wiring 162 is electrically connected to a cathode electrode 163 of the electron-emitting device. An aggregate 164 of carbon fibers is electrically connected to the cathode electrode 163 of the electron-emitting device. As can be seen from FIG. 15, These members 161, 163 and 164 are formed on a substrate 171. An anode electrode is disposed in opposition to the multi-electron source shown in FIG. 14 with spacers interposed therebetween, and the voltage Va which is positive with respect to the potential of each of the cathode electrodes is applied to the anode electrode. (refer to FIG. 7).

Figure 16:
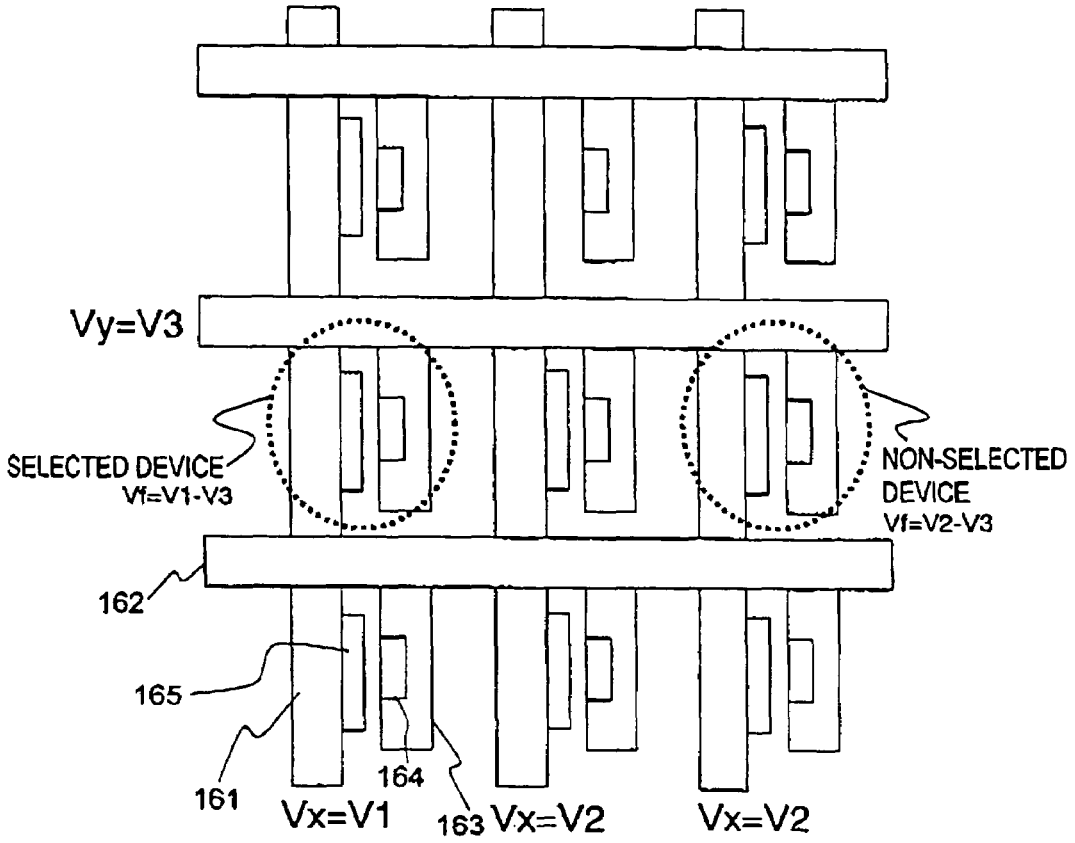
FIG. 16 is a schematic cross-sectional view aiding in describing the states of voltages to be applied during the driving of the multi-electron source.

FIG. 16 is a schematic cross-sectional view aiding in describing the states of voltages to be applied during the driving of the electron source according to Embodiment 3.

As shown in FIG. 16, in this electron source, a desired electron-emitting device can be selectively driven by selecting a desired column wiring and a desired row wiring and applying voltages. For example, a voltage of Vx=V1 is applied to a selected column wiring, while a voltage of Vx=V2 is applied to a non-selected column wiring. At the same time, a voltage of Vy=V3 is applied to a selected row wiring, whereby a driving voltage of Vf=V1−V3 is applied to an electron-emitting device which is connected to the selected row wiring and to the selected column wiring. In the meantime, a driving voltage of Vf=V2−V3 is applied to an electron-emitting device which is connected to the non-selected column wiring and to the selected row wiring. By setting the levels of the respective voltages V1, V2 and V3 to appropriate levels, it is possible to realize the state in which only the desired electron-emitting device is driven (is caused to emit electrons), whereas the other electron-emitting device is not driven (is inhibited from emitting electrons) By using this method, it is possible to individually know the electron emission characteristics of the respective electron-emitting devices. In addition, in the above-described method, it is possible to realize so-called line-sequential driving by sequentially switching row wirings to be selected. Incidentally, in the line-sequential driving, it is also possible to drive a plurality of lines at the same time by selecting a plurality of row wirings at the same time.

In an electron source formed by arranging a multiplicity of electron-emitting devices each using an aggregate of carbon fibers as an electron-emitting member, as in the invention, the electron emission characteristics of the respective electron-emitting devices are not necessarily uniform. For example, even in the case where the same driving voltage Vf is applied between the gate electrode 161 and the cathode electrode 163 of each of the electron-emitting devices, the amount of current emitted from each of the electron-emitting devices (the emission current Ie that reaches from each of the electron-emitting devices to the anode electrode) is not necessarily the same. This phenomenon seems to be caused in part by the fact that the aggregates of carbon fibers of the respective electron-emitting devices are not uniform in shape, and in part by the fact that there are errors (deviations) in the spaces between cathode electrodes and gate electrodes.

Figure 17:
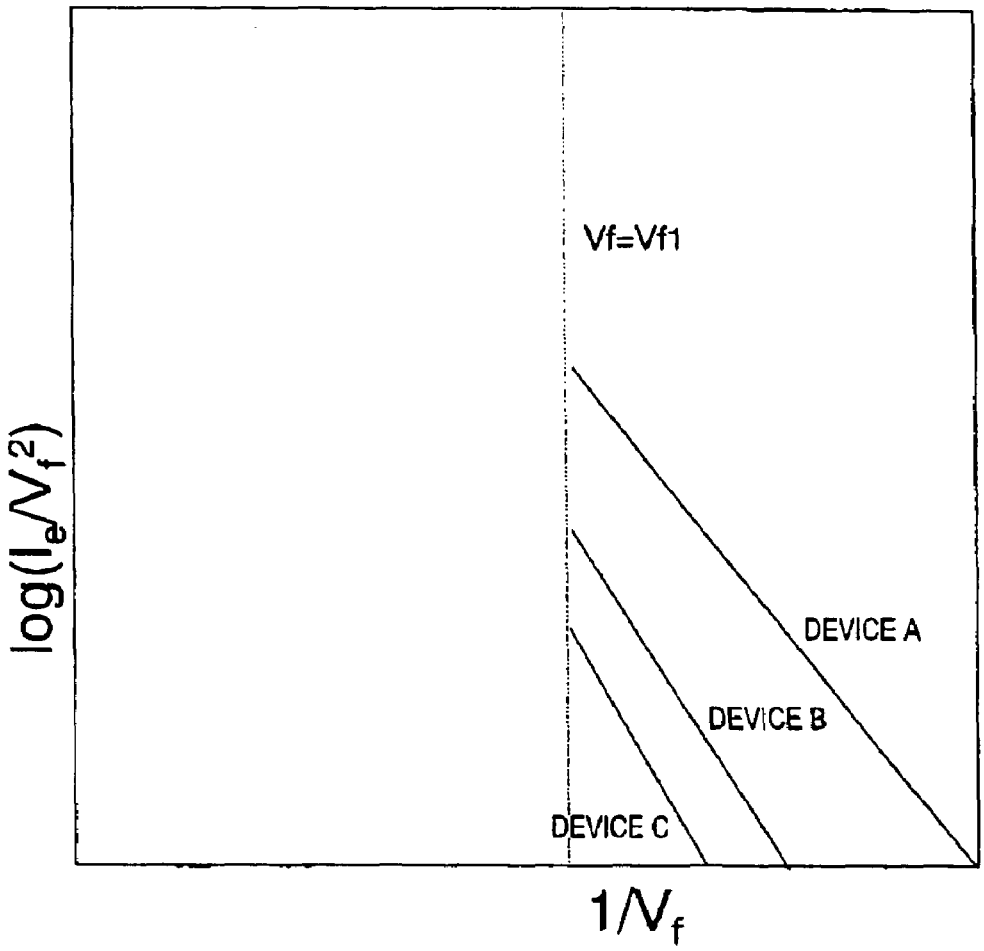
FIG. 17 is a graph comparatively showing different 1/Vf-log(Ie/Vf$^2$) characteristics of different electron-emitting devices.

FIG. 17 is a graph comparatively showing the respective $1/Vf\text{-}\log(Ie/Vf^2)$ characteristics of three electron-emitting devices (an electron-emitting device A, an electron-emitting device B and an electron-emitting device C). For example, assuming that the initial characteristics of the respective devices A, B and C differ as shown by F-N plots in FIG. 17, the absolute values of the inclinations of the F-N plots become larger in the order of the devices A, B and C, whereas their electron emission thresholds become smaller in the same order.

As described previously, electron-emitting devices which employ aggregates of carbon fibers as their electron emitting members have Vmax dependence. Accordingly, if an electron-emitting device is selected from the electron-emitting devices showing the respective electron emission characteristics shown in FIG. 17 and a voltage higher than the past maximum voltage applied to the selected electron-emitting device is applied to the selected electron-emitting device, the electron emission characteristic of the selected electron-emitting device shown in FIG. 17 can be shifted to the left.

This fact indicates that the electron emission characteristic of the device A can be shifted to the electron emission characteristic of the device C. Accordingly, by using this method, in the case where an unallowable difference exists in electron emission characteristic between electron-emitting devices which constitute an electron source, it is possible to accommodate the difference in electron emission characteristic between the electron-emitting devices within a predetermined range (it is possible to reduce the difference in electron emission characteristic). Specifically, in FIG. 17, when the device C is set to a device for use as a reference device, the I-V characteristics of the devices A and B can be made closer to the I-V characteristic of the device C.

Figure 18:
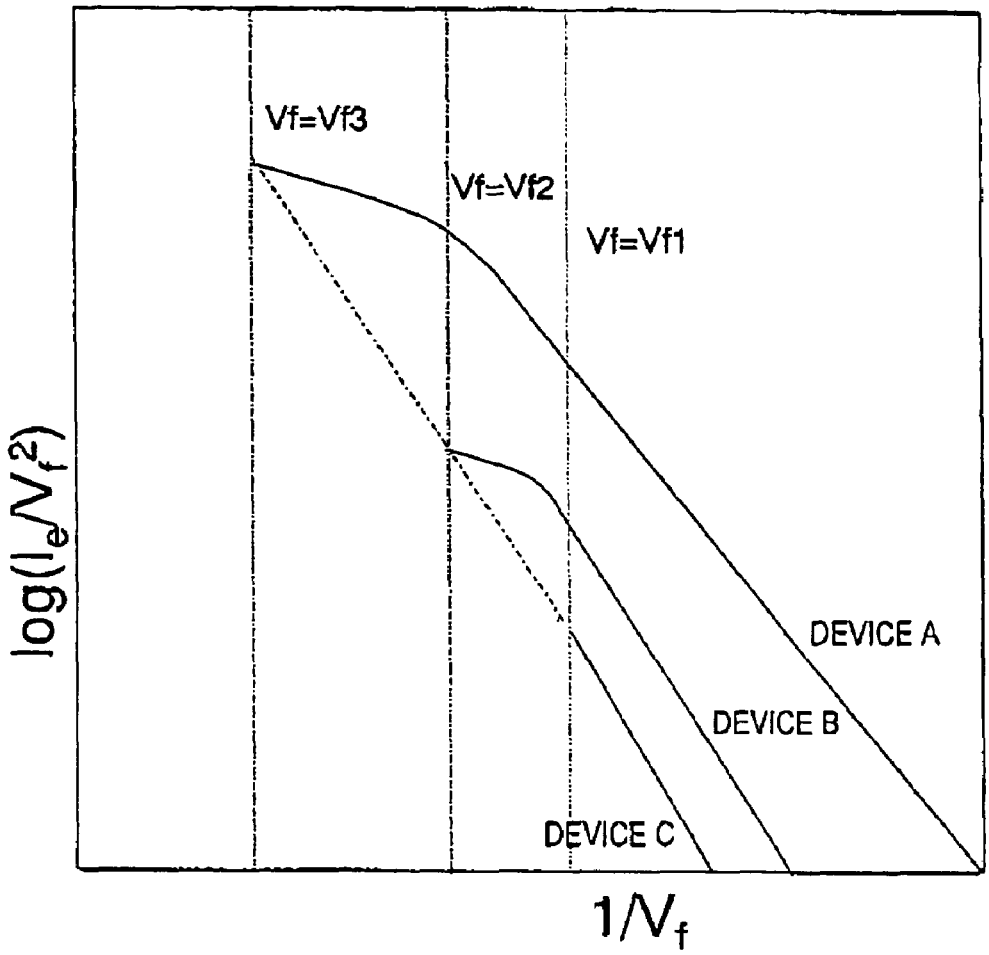
FIG. 18 is a graph comparatively showing different 1/Vf-log(Ie/Vf$^2$) characteristics for the purpose of describing a method of uniformizing the electron emission characteristics of different electron-emitting devices according to Embodiment 3 of the invention.

A method (characteristic adjusting method) of reducing the difference in electron emission characteristic between individual electron-emitting devices will be described below. In the following description, reference will be made to a method of reducing the difference in electron emission characteristic between individual electron-emitting devices in the case where an electron source includes three electron-emitting devices (an electron-emitting device A, an electron-emitting device B and an electron-emitting device C). More specifically, one example of a method of adjusting the electron emission characteristics of the devices A and B to the electron emission characteristic of the device C will be described below. FIG. 18 is a graph comparatively showing different $1/Vf\text{-}\log(Ie/Vf^2)$ characteristics for the purpose of describing a method of reducing the difference in electron emission characteristic between different electron-emitting devices. In the description of the following example, for the sake of simplicity of description, reference is made to an electron source including three electron-emitting devices, but as a matter of course, the number of electron-emitting devices which constitute an electron source is not limitative.

The method (characteristic adjusting method) of reducing the difference in electron emission characteristic between individual electron-emitting devices preferably includes a first step, a second step and a third step, all of which will be described below. However, the first and second steps need not be especially separate steps.

In the first step, the step of measuring the characteristics of the respective devices A, B and C is performed in order to check what initial characteristics the respective devices A, B and C have. In this characteristic measuring step, a characteristic measuring voltage is applied to each of the electron-emitting devices A, B and C. For example, if the voltage being applied to each of the electron-emitting devices A, B and C is increased from Vf=0 to $Vf=Vf_1$, it is possible to know the characteristics of the respective electron-emitting devices A, B and C.

In the second step, a reference device is selected in order to reduce the characteristic difference in the above-described low-voltage region between each of the devices A, B and C. As the reference device, for example, an electron-emitting device may be selected whose voltage (threshold voltage) necessary to observe the start of electron emission is the highest among a plurality of target electron-emitting devices. From among the three electron-emitting devices shown in FIG. 18, the device C is selected as an electron-emitting device which shows the highest threshold voltage. Otherwise, a reference device may also be selected by the method of selecting a device which shows the smallest value in emission current at $Vf=Vf_1$ or in $\log(Ie/Vf^2)$ at $Vf=Vf_1$. With this method as well, it is possible to select the device C from among the three electron-emitting devices shown in FIG. 18. Then, a reference value for the electron emission characteristics is found on the basis of the characteristic of the selected reference device. This step is called a reference value selecting step.

Then, in the third step, a characteristic shift voltage is applied to the other devices (the device A and the device B) so that the characteristic of each of the devices becomes a characteristic similar to that of the reference device selected in the above-described step 2. This step is called a characteristic shift step.

The maximum value of the above-described characteristic shift voltage is the maximum applied voltage Vmax of each of the devices A and B. Namely, the applied voltage of the device A is gradually increased, and as the applied voltage is increased above a certain voltage, the absolute value of the inclination of its F-N plots decreases sharply, and the device A enters the above-described high-voltage region. After the device A has entered the high-voltage region, the applied voltage is increased little by little. Each time the applied voltage is increased, the applied voltage is decreased once and the electron emission characteristic of the device A in a newly formed low-voltage region is checked, whereby the maximum applied voltage Vmax is increased until the characteristic of the device A becomes a characteristic similar to that of the reference device (the device C).

This method is an example which is carried out when, from the beginning, it is unknown to what number the value of Vmax to be applied to the device A should be set so that the characteristic of the device A becomes a characteristic similar to that of the device C. This method checks the electron emission characteristic of the device A in the low-voltage region each time the voltage applied to the device A is increased little by little. In this manner, when the maximum applied voltage Vmax of the device A is increased to $Vf=Vf_3$ (refer to FIG. 18), the characteristic of the device A becomes a characteristic similar to that of the device C. As to the device B, the maximum applied voltage Vmax of the device B is increased to $Vf\text{-}Vf_2$ (refer to FIG. 18) by the use of a similar method, whereby the characteristic of the device B becomes a characteristic similar to that of the device C.

By using the above-described characteristic shift step in this manner, the I-V characteristic of each of electron-emitting devices (the device A and the device B) which emits a relatively large number of electrons when a predetermined voltage is applied can be made closer to the I-V characteristic of an electron-emitting device (the device C) which emits a relatively small number of electrons when the predetermined voltage is applied. Then, after the characteristic shift step, the driving voltage V smaller than the maximum applied voltage Vmax used in the characteristic shift step is applied to each of the electron-emitting devices (between the cathode electrode and the counter electrode thereof), thereby driving each of the electron-emitting devices. In this manner, the desired number of electrons can be emitted from each of the electron-emitting devices with high reproducibility, whereby in an image display apparatus using such an electron source, it is possible to obtain good images with high uniformity.

The above description has referred to the method of adjusting the characteristics of the electron-emitting devices A and B to the initial characteristic of the electron-emitting device C. However, there is a case where the characteristic of the device C in the low-voltage region which has measured in the above-described characteristic measuring step does not satisfy the desired amount of emission current. In this case, it is preferable to apply the characteristic shift voltage to all the electron-emitting devices including th device C and increase the maximum applied voltages Vmax of all the devices, as will be described below. Specifically, first, in a manner similarly to the above-described method, an electron-emitting device which shows the highest threshold voltage (an electron-emitting device for use as a reference device) is selected from among a plurality of electron-emitting devices. Then, a voltage (a voltage in the high-voltage region) corresponding to the maximum applied voltage Vmax is applied to the selected electron-emitting device (the device C), thereby shifting the characteristic of the selected electron-emitting device (the device C) (extending the low-voltage region). This step is called a reference device voltage adjusting step. Then, after the dynamic range of the device C has been widened in this manner, the device C is selected as a reference device. Then, the electron emission characteristic of the device C obtained after the characteristic shift step is set to a reference value, and in a manner similar to the above-described method, the characteristic of each of the other electron-emitting devices (the device A and the device B) is shifted to a characteristic similar to that of the device C. In the description of the following example, for the sake of simplicity of description, reference is made to an electron source including three electron-emitting devices, but as a matter of course, the number of electron-emitting devices which constitute an electron source is not limitative.

Figure 19:
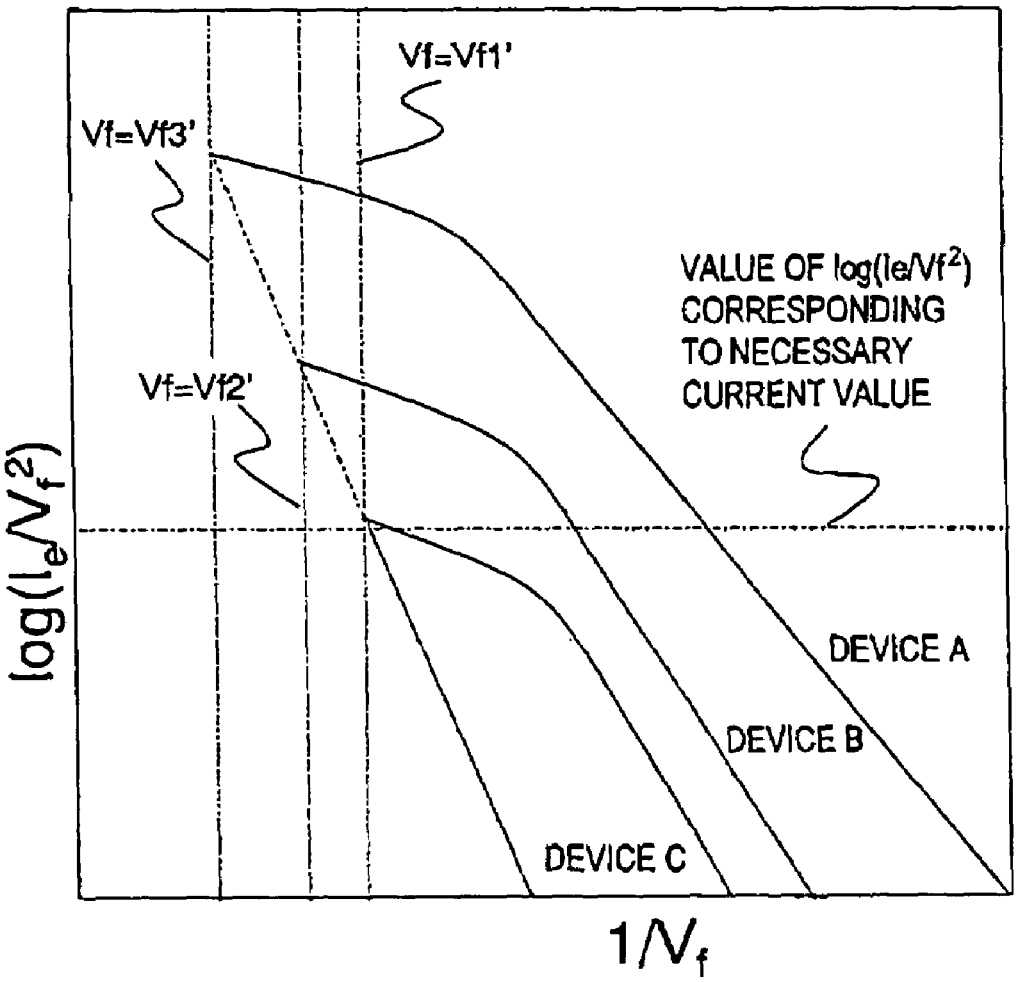
FIG. 19 is a graph comparatively showing different 1/Vf-log(Ie/Vf$^2$) characteristics for the purpose of describing a characteristic shift voltage applying step.

This method will be described below with reference to FIG. 19. First, the voltage Vf applied to the selected device (the device C) is increased until the emission current reaches a value corresponding to the desired amount of emission current on the vertical axis. Namely, the voltage applied to the device C is increased from Vf=0 V until the applied voltage reaches Vf=Vf1', whereby the maximum applied voltage Vmax of the selected device (the device C) is increased. Thus, the maximum applied voltage Vmax of the selected device (the device C) becomes Vf1'. After the characteristic of the device C has been shifted in this manner, the voltage applied to each of the devices A and B is increased in a manner similar to the above-described method so that the electron emission characteristic of each of the devices A and B becomes similar to the electron emission characteristic of the device C in the low-voltage region. In this step, the maximum voltages Vmax applied to the respective devices except the device C are determined. Namely, in FIG. 19, the maximum applied voltage Vmax of the device A becomes $Vf=Vf_3$, and the maximum applied voltage Vmax of the device B becomes $Vf=Vf_2$. By applying the above-described method to an electron source including a multiplicity of electron-emitting devices, each of the electron-emitting devices constituting the electron source can be made to emit the desired amount of current even in the case where there is not a single electron-emitting device which satisfies the desired electron emission characteristic in its initial state, and it is also possible to realize the state in which the difference in electron emission characteristic between each of the devices is small.

In this manner, the desired number of electrons can be emitted from each of the electron-emitting devices with high reproducibility, whereby in an image display apparatus using such an electron source, it is possible to obtain good images with high uniformity.

By using the above-described characteristic adjusting step, it is also possible to reduce the difference in electron emission characteristic between electron-emitting devices that occurs due to variations with time resulting from the driving of an electron source.

Figure 20:
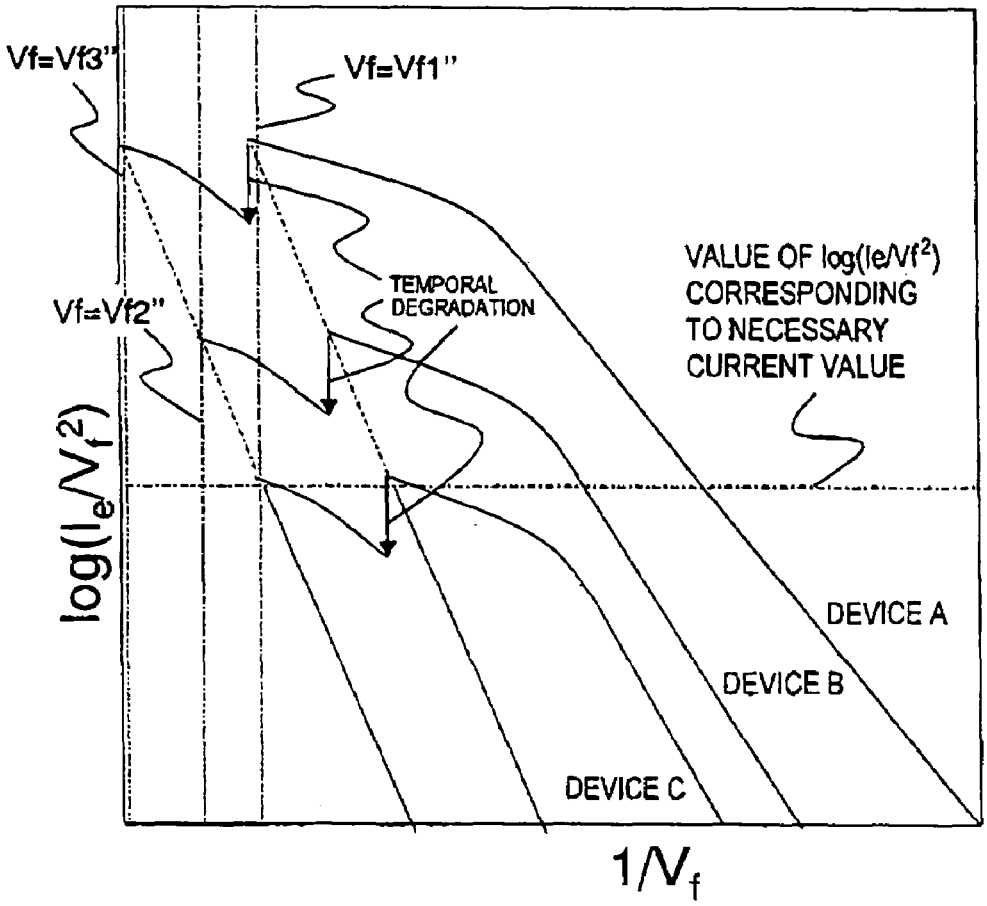
FIG. 20 is a graph comparatively showing different 1/Vf-log(Ie/Vf$^2$) characteristics for the purpose of describing a reference device voltage adjusting step.

FIG. 20 is a graph aiding in describing a step of uniformizing the characteristics of electron-emitting devices in the case where the characteristics of the respective electron-emitting devices have varied (degraded) as the result of the driving of an electron source as described above. FIG. 20 is a graph similar to FIG. 19, in which the vertical axis represents 1/Vf-log(Ie/$Vf^2$) and the horizontal axis represents 1/Vf. In the description of the following example, for the sake of simplicity of description, reference is made to an electron source including three electron-emitting devices, but as a matter of course, the number of electron-emitting devices which constitute an electron source is not limitative.

As shown in FIG. 20, if the individual electron-emitting devices degrade with time and a certain device (in this example, the device C) becomes unable to provide the necessary amount of emission current, for example, the characteristics of the respective devices A, B and C are measured, and voltages $Vf_{1''}$, $Vf_{2''}$ and $Vf_{3''}$ are finally applied to the respective devices A, B and C. These voltages $Vf_{1''}$, $Vf_{2''}$ and $Vf_{3''}$ are voltages higher than any applied voltages that the respective devices A, B and C have experienced before the application of the voltages $Vf_{1''}$, $Vf_{2''}$, and $Vf_{3''}$. By applying these voltages $Vf_{1''}$, $Vf_{2''}$ and $Vf_{3''}$ to the respective devices A, B and C, it is possible to reduce the difference in electron emission characteristic between each of the devices A, B and C. Thus, the electron source can be made to recover high uniformity and electron emission characteristics of high reproducibility. The above-described characteristic difference reducing method for the case where the difference in electron emission characteristic between each of the devices occurs during the driving thereof may also be executed at preset timing. Otherwise, the characteristic difference is periodically measured and only when the characteristic difference between each of the electron-emitting devices exceeds a predetermined range, the characteristic difference reducing method may be executed. In addition, the number of times by which the characteristic difference is reduced is not limitative.

In the above-described method of reducing the difference in electron emission characteristic between a plurality of electron-emitting devices, it is possible to measure the electron emission characteristic of each of the electron-emitting devices by measuring the relationship between an emission current emitted from an aggregate of carbon fibers to a counter electrode (for example, an anode electrode) and a driving voltage applied at this time. In addition, according to another means for measuring the electron emission characteristic of each of the devices, the ratio of the emission current emitted to the anode electrode to a current flowing into a cathode electrode may be measured to know the electron emission characteristic of each of the electron-emitting devices from the relationship between a device current flowing into the aggregate of carbon fibers and the driving voltage applied between the cathode electrode and the counter electrode at that time.

In addition, in the case where a luminescent material film such as a phosphor film is disposed on a surface of an anode electrode, it is also possible to make use of luminescence which occurs when electrons emitted from an aggregate of carbon fibers collide with the luminescent material. Namely, by measuring in advance the relationship between the emission current and the luminance strength of each electron-emitting device, it is possible know the electron emission characteristic of each electron-emitting device from the relationship between the luminescence strength and driving voltage.

In addition, the above-described characteristic adjusting step of Embodiment 3 may also be applied to a construction in which the counter electrodes of a plurality of electron-emitting devices are formed by one electrode. Namely, in the case where a plurality of electron-emitting devices of the type illustrated in Embodiment 1 or 2 are arranged, the anode electrode (denoted by reference numeral 95 in FIG. 2, and denoted by reference numeral 62 in FIG. 7) is formed as one continuous electrode. Accordingly, the counter electrodes of individual electron-emitting devices may also be formed by a single continuous electrode or by separate electrodes. In addition, even if the counter electrodes are formed as independent electrodes for the respective electron-emitting devices, the above-described characteristic adjusting step can be performed among the plurality of electron-emitting devices at the same time. Of course, even in the case where the counter electrodes of a plurality of electron-emitting devices are formed by a single continuous electrode, the above-described characteristic adjusting step can be performed among the plurality of electron-emitting devices at the same time. It is preferable to perform the characteristic adjusting step among a plurality of electron-emitting devices at the same time, because the time required for the entire manufacturing process can be reduced.

Each of the above-described embodiments 1 and 2 of the invention is characterized in that the voltage applied between the cathode electrode and the counter electrode during the driving of the electron-emitting device is set to a value which does not exceed the maximum voltage (Vmax) applied between the cathode electrode and the counter electrode during the manufacture of the electron-emitting device. However, this driving method presupposes that no variations occur in the relative position between the cathode electrode and the counter electrode during driving nor in the relative position between the cathode electrode and the counter electrode during manufacture. As a matter of course, it is most preferable that the relative position between the cathode electrode and the counter electrode do not vary during driving nor during manufacture, but it is also possible to positively vary the relative position between the cathode electrode and the counter electrode between driving and manufacture.

In this case, the electron emission characteristic (the above-described Vmax dependence) of each of the electron-emitting devices is not determined by only the above-described voltage. Accordingly, the above-described voltage can be replaced with a maximum applied field strength (Emax) before driving (typically, during manufacture) and an applied field strength during driving. As a matter of course, in the case where the relative position between the cathode electrode and the counter electrode does not vary between manufacture and driving, Vmax can be directly replaced with Emax.

For example, in the case of the electron-emitting device of two-terminal structure according to Embodiment 1, the anode electrode (counter electrode) 95 to be used during driving is disposed on the substrate 96 different from the substrate 92 on which the cathode electrode 93 is formed. In this case, the maximum voltage (Vmax) to be applied during manufacture can also be applied between the cathode electrode 93 and an electrode different from the anode electrode 95 to be used during driving. Namely, for example, a metal plate whose potential is controllable may be disposed above the cathode electrode 93 having the aggregate 94 of carbon fibers so that the voltage (Vmax) can be applied between the cathode electrode 93 and the metal plate. In this case, for example, the maximum field strength applied between the cathode electrode 93 and the counter electrode 95 during driving may be set to be lower than the field strength (Emax) applied between the cathode electrode 93 and the metal plate during manufacture. This ideal can be applied to the electron-emitting device of three-terminal structure described previously in Embodiment 2.

However, in the case where the electron emission characteristic of an electron-emitting device is determined by Emax, it is desired that an electric field (an electric field which governs electron emission) produced by voltage application (field application) before driving (typically, during manufacture) have an effectively similar relationship to an electric field which produced by voltage application (field application) during driving. In other words, it is desired that a great positional deviation do not occur in an aggregate of carbon fibers between a region in which electrons are emitted by voltage application before driving (typically, during manufacture) and a region in which electrons are emitted by voltage application during driving. Otherwise, there is a case where the reproducibility of the electron emission characteristic described above in connection with Embodiments 1 and 2 and the effect of the characteristic adjusting step described in connection with Embodiment 3 are not developed during driving.

In addition, the above-described maximum applied field strength Emax may also be replaced with a maximum emission current Imax. Namely, the maximum applied field strength Emax may also be replaced with the maximum emission current Imax obtained before driving (typically, during manufacture) and an emission current obtained during driving. In the case of an electron-emitting device of two-terminal structure, the maximum emission current Imax may also be simply replaced with a current flowing into the counter electrode. On the other hand, in the case of a three-terminal structure, the maximum emission current Imax may also be replaced with a current flowing into the anode electrode. As a matter of course, in the case where the relative position between the cathode electrode and the counter electrode does not vary between manufacture and driving, Vmax can be directly replaced with Imax. In addition, by using a metal plate as described in connection with the maximum applied field strength Emax, it is possible to positively effect variations in the relative position between the cathode electrode and the counter electrode between manufacture and driving.

EXAMPLES

Examples of the invention will be described below in detail.

Example 1

FIGS. 21A to 21D are schematic cross-sectional views aiding in describing a process of manufacturing the electron-emitting device according to Example 1.

(Step 1)

After the substrate 11 which was a silica substrate had been fully cleaned, a 5-nm-thick Ti layer for the gate electrode 12 and a 30-nm-thick poly-Si (arsenic-doped) layer for the cathode electrode 13 were continuously deposited on the substrate 11 by sputtering.

Then, a resist pattern was formed by a photolithography process using a positive photoresist (AZ1500/made by Clariant).

Figure 21A:
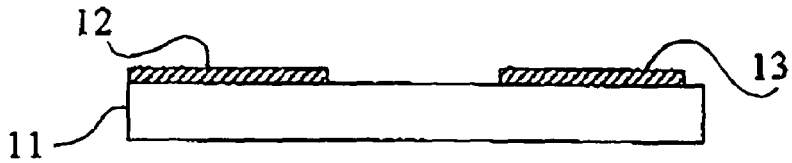
FIGS. 21A to 21D are schematic cross-sectional views aiding in describing a process of manufacturing the electron-emitting device.

Then, the poly-Si (arsenic-doped) layer and the Ti layer were dry-etched using a $CF_4$ gas by using the patterned photoresist as a mask. The extraction electrode 12 serving as a counter electrode and the cathode electrode 13 were formed with an electrode gap of 5 μm interposed therebetween (FIG. 21A).

(Step 2)

Then, a layer of Cr approxmately 100 nm thick was evaporated onto the entire substrate 11 by EB (electron beam) evaporation.

A resist pattern was formed by a photolithography process using a positive photoresist (AZ1500/made by Clariant).

Then, a region (100 μm square) to be coated with an electron-emitting material was formed on the cathode electrode 13 by using the patterned photoresist as a mask, and Cr in its openings was removed with a cerium nitrate-based etching solution.

After the resist had been removed, Pd and Co which were growth catalyzing metals for carbon fiber which was an electron-emitting material were formed in the ratio of 1 to 1 into an island-like shape by sputtering.

Figure 21B:
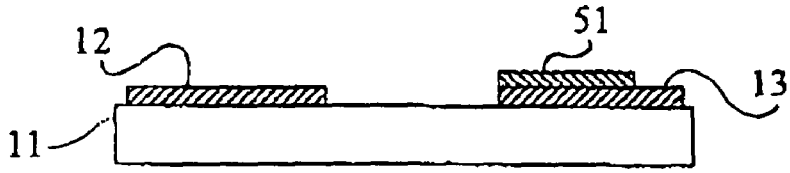

After the formation, Cr was removed with a cerium nitrate-based etching solution (FIG. 21B).

(Step 3)

Figure 21C:
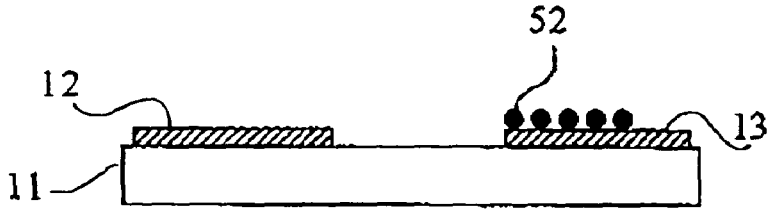
Figure 21D:
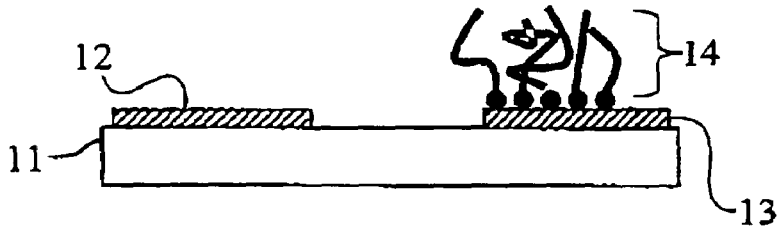

The substrate 11 was placed into a furnace, and after the air inside the furnace was evacuated to $10^{-4}$ Torr, a hydrogen gas diluted to 2% with nitrogen was charged up to atmospheric pressure. After that, the substrate 11 was exposed to heat treatment at 600° C. in a flow of the hydrogen gas. In this step, ultrafine particles 52 of particle diameter approximate 10–30 nm were formed on a device surface. The density of particles at this time was estimated at approximately $10^{11}$–$10^{12}$ particles/$cm^2$ (FIG. 21C).

(Step 4)

Subsequently, in addition to the hydrogen gas, an ethylene gas diluted to 1% with nitrogen was introduced and was exposed to heat treatment at 600° C. for 10 minutes in that atmosphere. Through observation with a scanning electron microscope, it was discovered that a multiplicity of fibrous carbons which had a diameter of approximately 30 nm to 50 nm and were extended in a bending fibrous form were formed on the Pd-coated region. The thickness of the fibrous carbons was approximately 1 μm.

This device was installed in the vacuum vessel 60 shown in FIG. 7, and the inside of the vacuum vessel 60 was sufficiently evacuated to a pressure of $2\times10^{-5}$ Pa by the evacuation unit 65. An anode voltage of Va=10 kV was applied to the anode electrode 61 remote from the device by H=2 mm. At this time, measurement was performed on the device current If and the electron emission current Ie which were made to flow when a pulse voltage made of the driving voltage Vf=15V was applied to the device.

The If and Ie characteristics of the device were similar to those shown in FIG. 8.

Namely, as the applied voltage Vf was increased from 0 V, the electron emission current Ie started to increase sharply at Vf=Vth. Then, the applied voltage Vf was increased to Vf=15 V, and was maintained at that voltage value. At this time, the electron emission current Ie of approximately 1 μA was measured. On the other hand, the characteristic of the device current If was similar to that of the electron emission current Ie, but the value of the device current If was at least one digit smaller than the value of the electron emission current Ie.

The voltage applied at this time was monotonously increased, but a curve which was F-N plotted in a voltage range of 0 V to a maximum value of 15 V extended through only an approximately linear low-voltage region and the bend of the approximately linear line into a high-voltage region was not measured in that voltage region. Accordingly, driving effected at this time is not driving effected in the high-voltage region. It was also discovered that plots on the F-N plotted curve of the electron emission current Ie=1 μA at the applied voltage Vf=15 V were in the low-voltage region of the driving of the electron-emitting device.

Then, since the voltage Vf=15 V was the maximum applied voltage Vmax, the voltage driving of the electron-emitting device according to the invention was sustained at a lower voltage Vf=14 V, whereby a stable emission current was obtained. In addition, it was found out that the electron-emitting device was able to be driven for a sufficiently long time.

In addition, when the device was driven at a far lower voltage Vf of as low as approximately 10 V, a stable emission current was still obtained.

Example 2

In the driving of an electron-emitting device using carbon fiber, fabricated by a process equivalent to the process of manufacturing the electron-emitting device according to Example 1, during an initial driving period, the voltage applied between the extraction electrode 12 and the cathode electrode 13 was monotonously increased from 0 V to 40 V, and then monotonously decreased. The F-N plots of the electron emission characteristic at this time showed an approximately linear relationship in a voltage increasing process of up to approximately 30 V (the current at this time was approximately 12 μA) The anode voltage at this time was Va=10 kV.

However, when the applied voltage was near 30 V, the absolute value of the inclination of the F-N plots decreased sharply, and again followed an approximately linear relationship in a voltage increasing process of increasing the applied voltage to not lower than 30 V. From this behavior, it can be considered that the boundary between the initial low-voltage region and the high-voltage region in the electron-emitting device according to Example 2 is Vf=approximately 30 V. After that, the applied voltage was increased to 40 V, and the emission current at this time was approximately 16 μA. After that, the applied voltage was decreased to 35 V, and it was observed at this time that the electron emission characteristic followed an approximately linear relationship different from that during the voltage increasing period. The emission current at the applied voltage of 35 V was approximately 13 μA.

Then, when the voltage driving of the electron-emitting device according to the invention was sustained at the voltage Vf=35 V, a stable emission current was obtained. In addition, it was found out that actual products of the electron-emitting device were able to withstand sufficiently-long-time driving Example 3

The fabricating method for the electron-emitting device according to Example 3 described previously with reference to FIGS. 3A to 3C will be described below in further detail.

(Step 1)

First, the TiN thin film 101 of thickness 100 nm was fabricated on the surface of the cathode substrate 102 by ion beam sputtering (FIG. 3A).

(Step 2)

Then, the catalyst particles 103 for promoting the growth of carbon fibers were fabricated on the TiN thin film 101 by RF sputtering (FIG. 3B) The catalyst particles 103 were fabricated by depositing an alloy containing 50 atm % palladium and 50 atm % cobalt on the cathode substrate 102. The thickness of the deposited film was approximately 20 Å.

(Step 3)

Then, the cathode substrate 102 on which the catalyst particles 103 were disposed was placed into a furnace, and the catalyst particles 103 was exposed to heat treatment at a temperature of 550° C. while a diluted hydrogen gas containing 2% hydrogen and 98% helium was being supplied to the furnace. Thus, an aggregate of the catalyst particles 103 was formed on the cathode substrate 102. The diameters of the catalyst particles 103 ranged between 5 nm and 30 nm (FIG. 3B).

(Step 4)

Then, the cathode substrate 102 was exposed to heat treatment at a temperature of 550° C. while a diluted hydrogen gas containing 2% hydrogen and 98% helium and a diluted ethylene gas containing 2% ethylene and 98% helium were being supplied to the furnace, whereby carbon fibers were formed. An aggregate of these carbon fibers had the form of a film, and the film thickness was approximately 7.5 μm. The diameters of the fibers ranged between 5 nm and 30 nm (FIG. 3C).

In the following description, a device which is constructed in such a manner that, as shown in FIG. 2, its anode electrode is disposed in opposition to the film fabricated on its electrode substrate by the above-described process with a spacer interposed therebetween is referred to as the "device A".

A device which is constructed as shown in FIG. 2 by using a film fabricated by a method similar to the above-described method is referred to as the "device B". The method is the same as the above-described method, except that the time period of heat treatment at a temperature of 550° C. in Step 4 is changed. The film thickness of an aggregate of carbon fibers in the device B was approximately 3 μm, and the diameters of the carbon fibers ranged between 5 nm and 30 nm.

Figure 22:
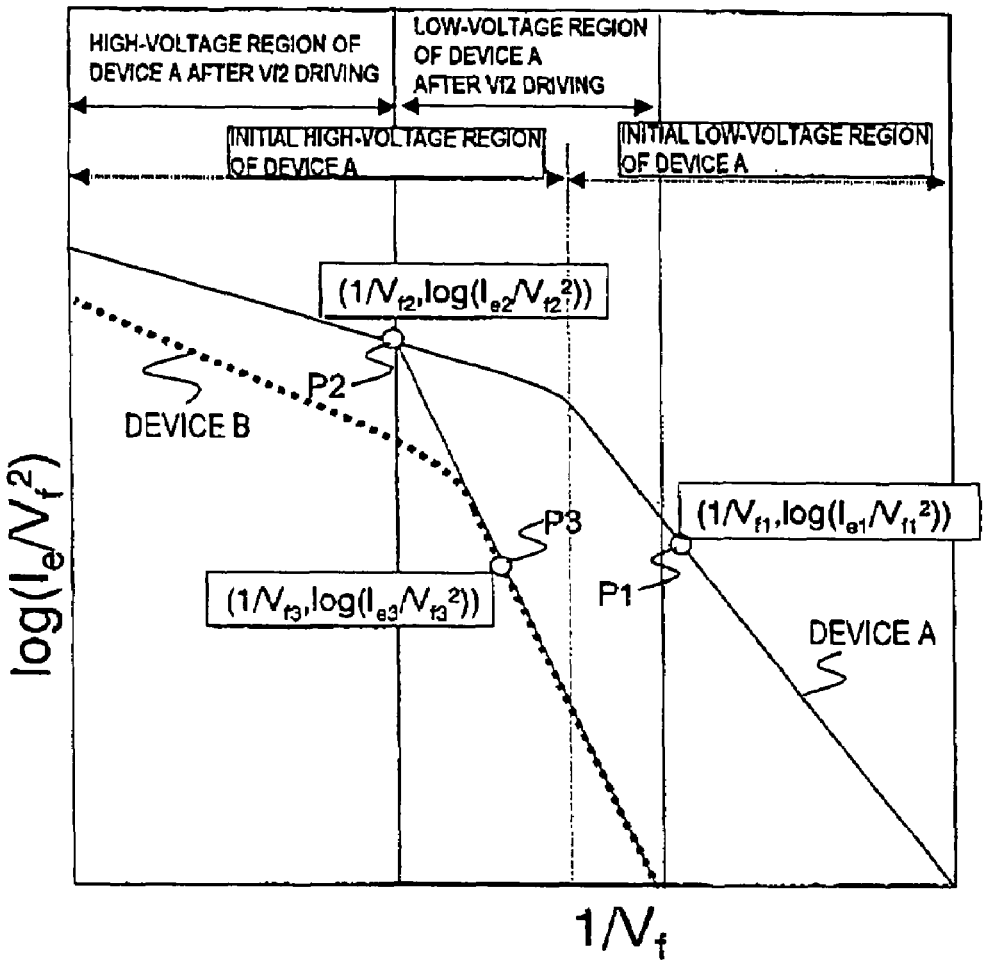
FIG. 22 is a graph showing the F-N characteristic of an electron-emitting device according to Example 2.
Figure 23:
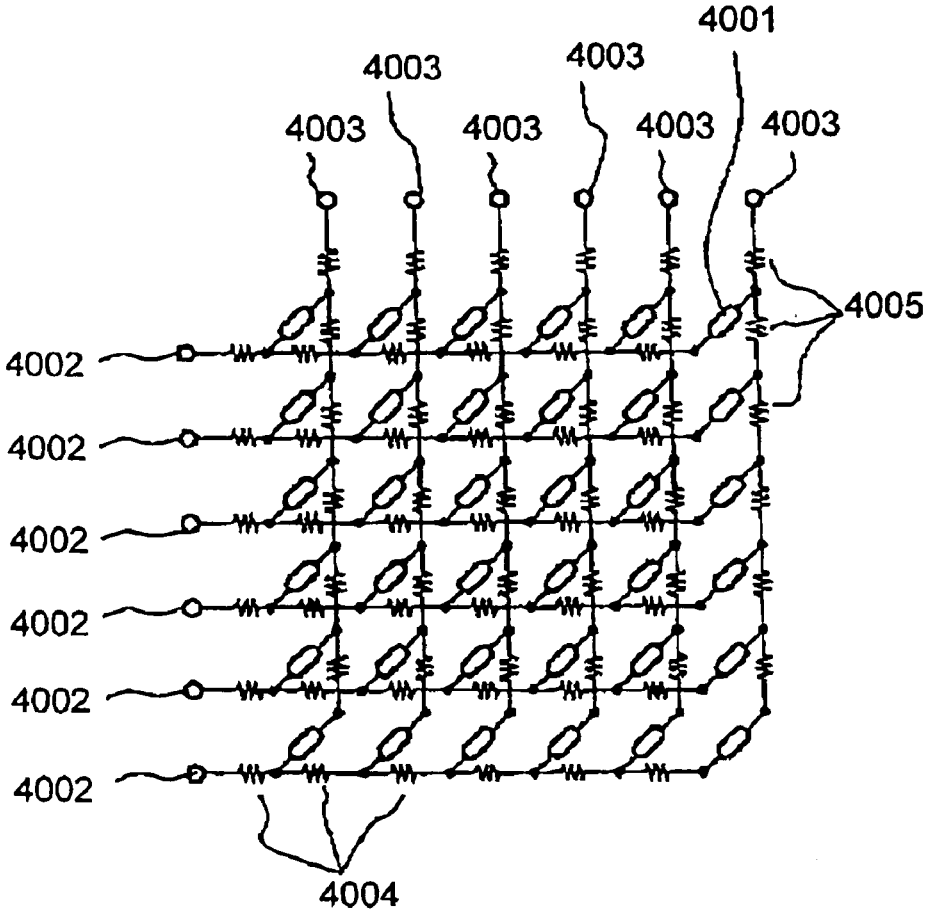
FIG. 23 is a schematic view of a multi-electron source.

FIG. 22 is a view showing the states of driving of the devices A and B. Let Va denote the driving voltage of the device A, and let Vb denote the driving voltage of the device B. First, the driving of the device B was started and the driving voltage Vb started to be increased from Vb=0 V, and an emission current Ieb started rising at a threshold voltage Vb=Vthb and the increase of the driving voltage is stopped at Vb=1.37 kV. At Vb=1.37 kV, the emission current Ieb=10 μA was obtained. A point on F-N plots indicative of this driving voltage is shown as a point P3 in FIG. 22. This driving voltage is in an approximately linear region of the F-N plots, that is to say, a low-voltage region. The increase of the driving voltage Vb of the device B was stopped at this voltage, and was then decreased to Vb=0 V to temporarily stop the driving of the device B. At this time, the voltage decrease drew a curve extending below the curve of the voltage increase and representing a somewhat smaller amount of current than the curve of the voltage increase, but the curve of the voltage decrease was in a range where the curve of the voltage decrease and the curve of the voltage increase were allowed to be regarded as approximately the same curve.

Then, the driving of the device A was started and the driving voltage Va started to be increased from Va=0 V, and an emission current Iea started to rise at a threshold voltage Va=Vtha. At this time Vtha<Vthb, and the threshold driving voltage value in the initial driving period of the device A was low with respect to the device B.

When the driving voltage was increased to Vfa=0.78 kV, the emission current Iea=8 μA was obtained. A point on F-N plots indicative of this driving voltage is shown as a point P1 in FIG. 22. The F-N plots of the device A at this time is in an approximately linear region, that is to say, the point P1 is in a low-voltage region. The value of β calculated from the curve in the low-voltage region containing the point P1 was 9/5 times as high as the value of β calculated from the curve in the low-voltage region containing the point P3 on the F-N plots of the device B. However, regarding α, the value of α calculated from the curve in the low-voltage region containing the point P1 on the F-N plots of the device A is 1/20 times as small as the value of α calculated from the curve in the low-voltage region containing the point P3 on the F-N plots of the device B.

Then, as the driving voltage Va of the device A was increased, a bend of the F-N plots occurs at Va=0.9 kV and the absolute value of the inclination of the F-N plots decreased. This fact indicates that the driving voltage of the device A entered the high-voltage region. Further, the driving voltage Va was increased to Va=1.8 kV, and the emission current at this time was Iea=2 mA. A point on the F-N plots indicative of this emission current is shown as a point P2 in FIG. 22.

Then, as the driving voltage Va was decreased, the driving voltage Va drew a curve different from the curve drawn during the increase, and the emission current decreased. This curve is approximately linear, and indicates that the driving voltage Va entered a new approximately linear region formed after the maximum applied voltage Vmax had been increased. This curves passed through the point P3. At the point P3, Va=1.37 kV and Iea=10 μA, and these values were approximately equal to those obtained from the device B. The values of α and β calculated from this voltage decrease curve were approximately equal to those obtained from the electron emission characteristic of the device B.

Namely, in Embodiment 3, a stable and good emission current was obtained when the maximum applied voltage Vmax (Va) between the cathode electrode and the counter electrode was set to 1.8 kV and the subsequent driving voltage was set to Va=1.37 kV.

Accordingly, according to Example 3, the electron emission characteristics of a plurality of electron-emitting devices using carbon fibers which differ in characteristic immediately after manufacture can be adjusted by controlling the maximum applied voltage Vmax of each of the electron-emitting devices, whereby stable driving can be performed on each of the devices.

In the case of an electron-emitting device having a three-terminal structure as shown in FIG. 7, the maximum applied voltage Vmax and the driving voltage V which are to be controlled may also be applied not to the applied voltage Vf between the extraction electrode and the cathode electrode but to the applied voltage Va between the cathode electrode and the anode electrode. Furthermore, it is preferable that, during the driving of the electron-emitting device, both of the applied voltages Vf and Va be made driving voltages smaller than the maximum applied voltages Vfmax and Vamax obtained in their respective histories.

With the electron-emitting device and the electron source driving method according to the invention, it is possible to realize the driving of an electron-emitting device using carbon fibers that makes it possible to restrain current degradation and maintain stable electron emission for a long time. Furthermore, with the manufacturing method for the multi-electron source according to the invention, it is possible to maintain uniform and suitable electron emission characteristics of the entire multi-electron source for a long time.

Example 4

In Example 4, an image display apparatus using electron-emitting devices of the three-terminal type fabricated in Example 1.

In Example 4, an electron source was formed by disposing a plurality of electron-emitting devices in a matrix form as shown in FIG. 14.

After that, a voltage which was increased from 0 V to a measurement voltage was applied to each of the electron-emitting devices constituting the electron source, and the electron emission characteristics of the respective electron-emitting devices were measured. Then, as described previously in Embodiment 3, the electron emission characteristic of an electron-emitting device showing the smallest amount of emission current was selected as a reference, and voltages exceeding the measured voltages were applied to the respective electron-emitting devices to reduce the difference between the reference and the electron emission characteristics of the other electron-emitting devices. Thus, the uniformity of the electron emission characteristic of each of the electron-emitting devices constituting the electron source was improved.

In addition, a face plate having a phosphor film for three primary colors and a metal back (anode electrode) made of Al covering the phosphor film was disposed above the electron source in opposition to each other, and the periphery of the obtained assembly was sealed to form a vacuum panel. A driving circuit was connected to this vacuum panel, and an image was displayed thereon. During image display, the driving voltage of each of the electron-emitting devices was set to a voltage lower than the measured voltage. Accordingly, it was possible to display an image of high uniformity with high stability.

What is claimed is:

1. A manufacturing method for an electron source composed of a plurality of electron-emitting devices, each of which emits electrons from an electron-emitting member by applying a driving voltage between a cathode electrode having the electron-emitting member and a counter electrode disposed in opposition to the cathode electrode, the method comprising the steps of:

(A) preparing a plurality of cathode electrodes each having an electron-emitting member, and a counter electrode opposed to the plurality of cathode electrodes;

(B) increasing an applying voltage that is applied between the counter electrode and a first cathode electrode having the first electron-emitting member in the cathode electrodes, from a voltage level lower than a first voltage level which is a maximum voltage level the first cathode electrode has experienced, to a second voltage level higher than the first voltage level;

(C) shifting a point where an inclination in an F-N plot of an electron-emitting characteristic of the first electron-emitting member changes from a point corresponding to the first voltage level to a point corresponding to the second voltage level so as to shift a voltage below which the first electron-emitting member is to be operated from the first voltage level to the second voltage level, as a result of increasing the applying voltage that is applied between the counter electrode and the first cathode electrode having the first electron-emitting member in the cathode electrodes from the voltage level lower than the first voltage level to the second voltage level; and (D) reducing a difference of (i) an electron-emitting characteristic of a second electron emitting member being operative to emit a relatively greater number of electrons when a predetermined voltage is applied between a second cathode electrode having the second electron-emitting member in the cathode electrodes and the counter electrode and (ii) the electron emitting characteristic of the first electron emitting member being operative to emit a relatively lesser number of electrons when the predetermined voltage is applied between the first cathode electrode and the counter electrode, as a result of increasing the applying voltage that is applied between the counter electrode and the first cathode electrode having the first electron-emitting member in the cathode electrodes from the voltage level lower than the first voltage level to the second voltage level.

2. A manufacturing method for the electron source according to claim 1, wherein the electron-emitting member includes a carbon fiber.

3. A manufacturing method for the electron source according to claim 2, wherein the carbon fiber is a carbon nanotube and/or a graphite nanofiber.

4. A manufacturing method for the electron source according to claim 1, wherein a maximum voltage of the applying voltage is greater than the driving voltage.

5. A manufacturing method for an image display apparatus composed of an electron source and a luminescent material film, wherein said electron source is manufactured by the manufacturing method according to claim 4.

6. A manufacturing method for an electron emitting device composed of a cathode electrode and a counter electrode disposed in opposition to the cathode electrode, comprising the steps of:

(A) preparing a cathode electrode and a counter electrode that is opposed to the cathode electrode;

(B) increasing an applying voltage that is applied between the cathode electrode and the counter electrode, from a voltage level lower than a first voltage level which is a maximum voltage level the cathode electrode has experienced, to a second voltage level higher than the first voltage level; and (C) shifting a point where an inclination in an F-N plot of an electron-emitting characteristic of the cathode electrode changes from a point corresponding to the first voltage level to a point corresponding to the second voltage level so as to shift a voltage below which the electron emitting device is to be operated from the first voltage level to the second voltage level, as a result of increasing the applying voltage that is applied between the cathode electrode and the counter electrode from the voltage level lower than the first voltage level to the second voltage level.

7. A manufacturing method for the electron emitting device according to claim 6, wherein a maximum voltage of the applying voltage is higher than a driving voltage of the electron emitting device.

8. A manufacturing method for the electron emitting device according to claim 6, further comprising a step of preparing an electron emitting member including a carbon fiber on the electron emitting member.

9. A manufacturing method for the electron emitting device according to claim 8, wherein the carbon fiber is a carbon nanotube and/or a graphite nanofiber.

10. A manufacturing method for an image display apparatus composed of an electron emitting device and a luminescent material film, wherein said electron emitting device is manufactured by the manufacturing method according to claim 6.

11. A characteristic adjusting method for adjusting an electron emitting characteristic of an electron emitting device composed of a cathode electrode having a plurality of carbon fibers and a counter electrode disposed in opposition to the cathode electrode, comprising the steps of:

increasing an applying voltage that is applied between the cathode electrode and the counter electrode from a voltage level lower than a first voltage level which is a maximum voltage level the cathode electrode has experienced, to a second voltage level higher than the first voltage level; and shifting a point where an inclination in an F-N plot of an electron-emitting characteristic of the electron-emitting device of the cathode electrode changes from a point corresponding to the first voltage level to a point corresponding to the second voltage level so as to shift a voltage below which the electron emitting device is to be operated from the first voltage level to the second voltage level, as a result of increasing the applying voltage that is applied between the cathode electrode and the counter electrode from the voltage level lower than the first voltage level to the second voltage level.

12. An image display apparatus having (i) a plurality of electron emitting devices each of which emits electrons from an electron emitting member by applying a driving voltage between a cathode electrode having the electron emitting member composed of a plurality of carbon fibers and a counter electrode disposed in opposition to the cathode electrode and (ii) a luminescent material film, wherein said image display apparatus is manufactured by the manufacturing method according to claim 5.

13. An image display apparatus having (i) a plurality of electron emitting devices each emits electrons from an electron emitting member by applying a driving voltage between a cathode electrode having the electron emitting member composed of a plurality of carbon fibers and a counter electrode disposed in opposition to the cathode electrode and (ii) a luminescent material film, wherein said image display apparatus is manufactured by the manufacturing method according to claim 10.

14. A manufacturing method for an electron source composed of a plurality of electron emitting devices, each of which emits electrons from an electron emitting member by applying a driving voltage between a cathode electrode having the electron emitting member and a counter electrode disposed in opposition to the cathode electrode, comprising the steps of:

(A) preparing a plurality of cathode electrodes each having an electron emitting member, and a plurality of counter electrodes that are respectively opposed to the plurality of cathode electrodes;

(B) increasing an applying voltage that is applied between a first cathode electrode having a first electron-emitting member in the cathode electrodes and a first counter electrode opposed to the first cathode electrode in the counter electrodes, from a voltage level lower than a first voltage level which is a maximum voltage level the cathode electrodes have experienced, to a second voltage level higher than the first voltage level;

(C) shifting a point where an inclination in an F-N plot of an electron-emitting characteristic of the first electron-emitting member changes from a point corresponding to the first voltage level to a point corresponding to the second voltage level so as to shift a voltage below which the first electron-emitting member is to be operated from the first voltage level to the second voltage level, as a result of increasing the applying voltage that is applied between the first cathode electrode and the first counter electrode from the voltage level lower than the first voltage level to the second voltage level; and (D) reducing a difference of (i) an electron-emitting characteristic of a second electron emitting member being operative to emit a relatively greater number of electrons when a predetermined voltage is applied between a second cathode electrode having the second electron emitting member in the cathode electrodes and a second counter electrode opposed to the second cathode electrode, different from the first counter electrode in the counter electrodes and (ii) the electron emitting characteristic of the first electron emitting member being operative to emit a relatively lesser number of electrons when the predetermined voltage is applied between the first cathode electrode and the first counter electrode, as a result of increasing the applying voltage that is applied between the first cathode electrode and the first counter electrode from the voltage level lower than the first voltage level to the second voltage level.

15. A manufacturing method for the electron source according to claim 14, wherein the electron emitting member includes a carbon fiber.

16. A manufacturing method for the electron source according to claim 15, wherein the carbon fiber is a carbon nanotube and/or a graphite nanofiber.

17. A manufacturing method for the electron source according to claim 14, wherein a maximum voltage of the applying voltage is higher than the driving voltage.

18. A manufacturing method for an image display apparatus composed of an electron source and a luminescent material film, wherein said electron source is manufactured by the manufacturing method according to claim 14.

19. A method of manufacturing and operating an electron source composed of a plurality of electron-emitting devices, each of which emits electrons from an electron-emitting member by applying a driving voltage between a cathode electrode having the electron-emitting member and a counter electrode disposed in opposition to the cathode electrode, the method comprising the steps of:

(A) preparing a plurality of cathode electrodes each having an electron-emitting member, and a counter electrode opposed to the plurality of cathode electrodes;

(B) increasing an applying voltage that is applied between the counter electrode and a first cathode electrode having the first electron-emitting member in the cathode electrodes, from a voltage level lower than a first voltage level which is a maximum voltage level the first cathode electrode has experienced, to a second voltage level higher than the first voltage level;

(C) shifting a point where an inclination in an F-N plot of an electron-emitting characteristic of the first electron-emitting member changes from a point corresponding to the first voltage level to a point corresponding to the second voltage level so as to shift a voltage below which the first electron-emitting member is to be operated from the first voltage level to the second voltage level, as a result of increasing the applying voltage that is applied between the counter electrode and the first cathode electrode having the first electron-emitting member in the cathode electrodes from the voltage level lower than the first voltage level to the second voltage level;

(D) reducing a difference of (i) an electron-emitting characteristic of a second electron emitting member being operative to emit a relatively greater number of electrons when a predetermined voltage is applied between a second cathode electrode having the second electron-emitting member in the cathode electrodes and the counter electrode and (ii) the electron emitting characteristic of the first electron emitting member being operative to emit a relatively lesser number of electrons when the predetermined voltage is applied between the first cathode electrode and the counter electrode, as a result of increasing the applying voltage that is applied between the counter electrode and the first cathode electrode having the first electron-emitting member in the cathode electrodes from the voltage level lower than the first voltage level to the second voltage level; and (E) operating the electron source by applying a voltage having a level lower than the second voltage level between the counter electrode and the first cathode electrode.

20. A method for manufacturing and operating an electron emitting device composed of a cathode electrode and a counter electrode disposed in opposition to the cathode electrode, comprising the steps of:

(A) preparing a cathode electrode and a counter electrode that is opposed to the cathode electrode;

(B) increasing an applying voltage that is applied between the cathode electrode and the counter electrode from a voltage level lower than a first voltage level which is a maximum voltage level the cathode electrode has experienced, to a second voltage level higher than the first voltage level;

(C) shifting a point where an inclination in an F-N plot of an electron-emitting characteristic of the cathode electrode changes from a point corresponding to the first voltage level to a point corresponding to the second voltage level so as to shift a voltage below which the electron emitting device is to be operated from the first voltage level to the second voltage level, as a result of increasing the applying voltage that is applied between the cathode electrode and the counter electrode from the voltage level lower than the first voltage level to the second voltage level; and (D) operating the electron-emitting device by applying a voltage having a level lower than the second voltage level between the counter electrode and the cathode electrode.

21. A characteristic adjusting method for adjusting an electron emitting characteristic of an electron emitting device composed of a cathode electrode having a plurality of carbon fibers and a counter electrode disposed in opposition to the cathode electrode and for operating the electron-emitting device, comprising the steps of:

increasing an applying voltage that is applied between the cathode electrode and the counter electrode from a voltage level lower than a first voltage level which is a maximum voltage level the cathode electrode has experienced, to a second voltage level higher than the first voltage level;

shifting a point where an inclination in an F-N plot of an electron-emitting characteristic of the electron-emitting device of the cathode electrode changes from a point corresponding to the first voltage level to a point corresponding to the second voltage level so as to shift a voltage below which the electron emitting device is to be operated from the first voltage level to the second voltage level, as a result of increasing the applying voltage that is applied between the cathode electrode and the counter electrode from the voltage level lower than the first voltage level to the second voltage level; and operating the electron-emitting device by applying a voltage having a level lower than the second voltage level between the counter electrode and the cathode electrode.

* * * * *